US009081340B2

(12) United States Patent
Suzuki

(10) Patent No.: US 9,081,340 B2
(45) Date of Patent: Jul. 14, 2015

(54) IMAGE FORMING APPARATUS HAVING FIRST AND SECOND COOLING PORTIONS OR FANS COOLING END REGIONS OF A FIXING PORTION WITH RESPECT TO A DIRECTION PERPENDICULAR TO A RECORDING MATERIAL CONVEYANCE DIRECTION

(75) Inventor: Junji Suzuki, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 13/486,323

(22) Filed: Jun. 1, 2012

(65) Prior Publication Data

US 2012/0308256 A1 Dec. 6, 2012

(30) Foreign Application Priority Data

Jun. 3, 2011 (JP) ..... 2011-125268

(51) Int. Cl.
*G03G 21/20* (2006.01)
*G03G 15/20* (2006.01)

(52) U.S. Cl.
CPC ..... *G03G 15/2042* (2013.01)

(58) Field of Classification Search
CPC ..... G03G 15/2042
USPC ..... 399/33, 69, 92
See application file for complete search history.

(56) References Cited

U.S. PATENT DOCUMENTS

| | | | | |
|---|---|---|---|---|
| 7,228,087 | B2 * | 6/2007 | Nagase | 399/92 |
| 7,609,991 | B2 * | 10/2009 | Koshida | 399/92 |
| 7,715,747 | B2 * | 5/2010 | Kitozaki | 399/92 |
| 7,890,002 | B2 * | 2/2011 | Kimura et al. | 399/69 X |
| 7,890,014 | B2 * | 2/2011 | Koshida | 399/92 |
| 2008/0025746 | A1 | 1/2008 | Kanai | |

FOREIGN PATENT DOCUMENTS

| | | | |
|---|---|---|---|
| JP | 2003-76209 | A | 3/2003 |
| JP | 2008-32903 | A | 2/2008 |
| JP | 2008-32904 | A | 2/2008 |
| JP | 2008-40235 | A | 2/2008 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes: a fixing portion for fixing an image on a recording material by heating the image carried on the recording material while conveying the recording material by a fixing nip; a first cooling portion for cooling one end region of the fixing portion with respect to a direction perpendicular to a recording material conveyance direction; and a second cooling portion for cooling the other end region of the fixing portion with respect to the direction perpendicular to the recording material conveyance direction. The first cooling portion and the second cooling portion are operable independently from each other.

20 Claims, 24 Drawing Sheets

IMAGE FORMING APPARATUS HAVING FIRST AND SECOND COOLING PORTIONS OR FANS COOLING END REGIONS OF A FIXING PORTION WITH RESPECT TO A DIRECTION PERPENDICULAR TO A RECORDING MATERIAL CONVEYANCE DIRECTION

FIELD OF THE INVENTION AND RELATED ART

The present invention relates to an image forming apparatus.

In the image forming apparatus forming an image on a recording material, the recording materials with various widths and lengths are passed through a fixing device. Here, when sheets of the recording material (small-sized paper) having a width narrower than a maximum width of a maximum-sized paper capable of being subjected to sheet passing and printing in the image forming apparatus are continuously passed through the fixing device, a so-called "non-sheet-passing portion temperature rise" is generated in the fixing device. That is, the non-sheet-passing portion temperature rise is such a phenomenon that due to the difference in heat consumption between a recording material passing portion and a recording material non-passing portion in the fixing device, the degree of temperature rise at the recording material non-passing portion becomes large. As one of methods for suppressing this non-sheet-passing portion temperature rise, a cooling mechanism for cooling the non-sheet-passing portion by blowing the air against the non-sheet-passing portion is known.

Incidentally, as the type of the image forming apparatus, there are two types including a center-reference apparatus in which the recording material is conveyed by aligning its widthwise center (line) with a convey reference (line) and a one-side-reference apparatus in which the recording material is conveyed by aligning its widthwise edge with the convey reference (line). In the case of the center-reference apparatus, the above-described non-sheet-passing portion temperature rise is generated at both end portions of a fixing portion. Therefore, the cooling mechanism is required to blow the air against the both end portions of the fixing portion.

In such a center-reference apparatus, a user sets the recording material without aligning the recording material with the reference (line) in some cases. For example, when the small-sized paper is set, two regulating plates for regulating both widthwise ends of the recording material are spaced to positions for the maximum-sized recording material and the small-sized paper is not set at the center line, but is set along one of the regulating plate and is passed through the fixing device (hereinafter, this sheet passing is referred to as lateral shifting sheet passing). When the recording material is passed through the fixing device in such an erroneous set state, at the fixing portion, only one of the end portions is abnormally increased in temperature. In the case where this temperature rise is intended to be suppressed by the cooling mechanism described above, the other end portion, where the temperature is not increased, is also cooled. When a reference where there is no need to lower the temperature is cooled, the heat quantity necessary to fix the image becomes insufficient, thus causing improper fixing.

SUMMARY OF THE INVENTION

A principal object of the present invention is to provide an image forming apparatus capable of suppressing, in the case where a recording material is subjected to lateral shifting sheet passing, deterioration in its fixing property on a side where the recording material is subjected to the lateral shifting sheet passing and also capable of suppressing a temperature rise with reliability in a reference where the recording material is not passed through a fixing member.

According to an aspect of the present invention, there is provided an image forming apparatus comprising: a fixing portion for fixing an image on a recording material by heating the image carried on the recording material while conveying the recording material by a fixing nip; a first cooling portion for cooling one end region of the fixing portion with respect to a direction perpendicular to a recording material conveyance direction; and a second cooling portion for cooling the other end region of the fixing portion with respect to the direction perpendicular to the recording material conveyance direction, wherein the first cooling portion and the second cooling portion are operable independently from each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, embodiments for carrying out the present invention will be exemplarily described in detail. However, dimensions, materials, shapes and relative configurations of constituent elements described in the following embodiments should be appropriately changed depending on constitutions and various conditions of image forming apparatuses to which the present invention is applied. Therefore, unless otherwise noted specifically, the scope of the present invention is not limited to those in the following embodiments.

Embodiment 1

A color image forming apparatus in this embodiment will be described specifically with reference to the drawings. The description will be provided in the order of a general structure of the image forming apparatus, a fixing device (fixing portion), a control means, and a cooling control sequence during lateral shifting sheet passing. Examples of the image forming apparatus in this embodiment may include a copying machine, a laser beam printer and a facsimile machine.

(Image Forming Apparatus)

Figure 2:
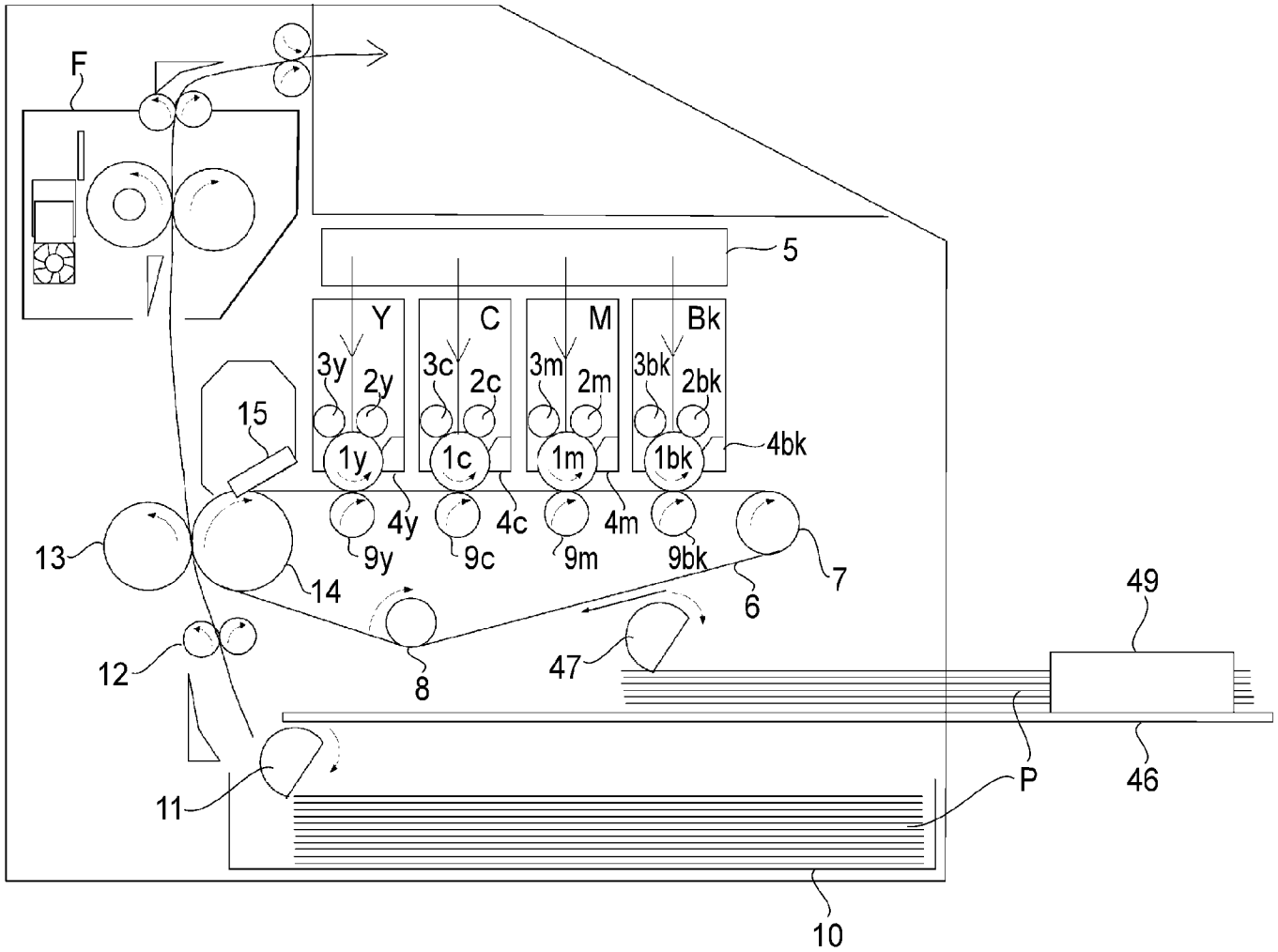
FIG. 2 is a schematic sectional view showing a structure of an image forming apparatus in Embodiment 1.

FIG. 2 shows a schematic structure sectional view of the color image forming apparatus in this embodiment. The color image forming apparatus is of an electrophotographic type and obtains a full-color image by superposing toner images (developer images) of four colors of yellow (Y), cyan (C), magenta (M) and black (Bk). The image forming apparatus includes four process cartridges Y, C, M and Bk for forming the color toner images of yellow, cyan, magenta and black, respectively. These process cartridges Y, C, M and Bk are provided in this order in a left-right direction. Each of the process cartridges Y, C, M, Bk is a so-called all-in-one cartridge as a unit in which the following means are incorporated and assembled. That is, the all-in-one cartridges Y, C, M and Bk includes photosensitive drums 1*y*, 1*c*, 1*m* and 1*bk* as an image bearing member, charging rollers 2*y*, 2*c*, 2*m* and 2*bk* as a charging means, developing means 3*y*, 3*c*, 3*m* and 3*bk* for visualizing an electrostatic latent image, cleaning means 4*y*, 4*c*, 4*m* and 4*bk* for the photosensitive drums 1*y*, 1*c*, 1*m* and 1*bk*, and the like. In the developing means 3*y*, 3*c*, 3*m* and 3*bk* of the process cartridges Y (yellow), C (cyan), M (magenta) and Bk (black), toners of yellow, cyan, magenta and black are accommodated, respectively.

An optical system 5 for forming electrostatic latent images by subjecting the photosensitive drums 1*y*, 1*c*, 1*m* and 1*bk* to light exposure is provided correspondingly to the four color process cartridges. As the optical system 5, a laser scanning exposure optical system is used. In the respective process cartridges Y, C, M and Bk, the photosensitive drums 1*y*, 1*c*, 1*m* and 1*bk* uniformly charged by the charging means 2*y*, 2*c*, 2*m* and 2*bk* are subjected to scanning exposure on the basis of image data by the optical system 5. As a result, the electrostatic latent images corresponding to the image data are formed on the surfaces of the photosensitive drums 1*y*, 1*c*, 1*m* and 1*bk*. A developing bias applied from an unshown bias power source to developing rollers of the developing means 3*y*, 3*c*, 3*m* and 3*bk* is set at a proper value between a charge potential and a latent image (exposed portion) potential. As a result, toners generally charged to the negative polarity are electrostatically attracted to the electrostatic latent images on the photosensitive drums 1*y*, 1*c*, 1*m* and 1*bk* to develop the electrostatic latent images on the photosensitive drums 1*y*, 1*c*, 1*m* and 1*bk*. That is, on the photosensitive drums 1*y*, 1*c*, 1*m* and 1*bk* of the process cartridges Y, C, M and Bk, a yellow toner image, a cyan toner image, a magenta toner image and a black toner image are formed, respectively.

The single-color toner images formed by development on the photosensitive drums 1*y*, 1*c*, 1*m* and 1*bk* of the process cartridges Y, C, M and Bk are successively primary-transferred superposedly onto an intermediary transfer member 6, in a predetermined alignment state, which is rotated substantially at the same speed as that of the photosensitive drums 1 in synchronism with rotation of the photosensitive drums 1. As a result, a full-color toner image is synthetically formed on the intermediary transfer member 6. In this embodiment, as the intermediary transfer member 6, an endless intermediary transfer belt is used and is extended and stretched by three rollers consisting of a driving roller 7, a secondary transfer opposite roller 14 and a tension roller 8, and is driven by the driving roller 7. Hereinafter, the intermediary transfer member 6 is referred to as an intermediary transfer belt 6.

As a primary transfer means for transferring the toner images from the photosensitive drums 1*y*, 1*c*, 1*m* and 1*bk* of the process cartridges Y, C, M and Bk onto the intermediary transfer belt 6, primary transfer rollers 9*y*, 9*c*, 9*m* and 9*bk* are used. To the primary transfer rollers 9*y*, 9*c*, 9*m* and 9*bk*, a primary transfer bias of a polarity (generally the positive polarity) opposite to the toner charge polarity is applied from an unshown bias power source portion. As a result, the toner images are primary-transferred from the photosensitive drums 1 of the process cartridges Y, C, M and Bk onto the intermediary transfer belt 6. Toners remaining on the photosensitive drums 1 after the primary transfer are removed by the cleaning means 4*y*, 4*c*, 4*m* and 4*bk*. In this embodiment, as the cleaning means 4*y*, 4*c*, 4*m* and 4*bk*, control removing cleaning using an urethane blade is effected.

On the other hand, a recording material P set in a recording material cassette 10 as a recording material supplying portion is fed by a feeding roller 11. Incidentally, in the image forming apparatus in this embodiment, a maximum sheet width is a LETTER size, and the recording material P is conveyed by using the center line thereof as a conveyance reference (line) with respect to the widthwise direction the conveyance direction. Further, by a registration roller 12, with predetermined control timing, the recording material P is conveyed to a nip between a secondary transfer roller 13 as a secondary transfer means and a portion of the intermediary transfer belt 6 stretched around the secondary transfer opposite roller 14. The primary transfer toner images transferred on the intermediary transfer belt 6 are collectively transferred onto the recording material P by a bias, of a polarity opposite to the toner charge polarity, applied from an unshown power source portion to the secondary transfer roller 13 as the secondary transfer means. Secondary transfer residual toner remaining on the intermediary transfer belt 6 after the secondary transfer is removed by an intermediary transfer belt cleaning means 15. In this embodiment, similarly as in the case of the cleaning means 4*y*, 4*c*, 4*m* and 4*bk* for the photosensitive drums 1*y*, 1*c*, 1*m* and 1*bk*, intermediary transfer member cleaning using the urethane blade is effected.

The toner image which is secondary-transferred onto the recording material P is passed through a fixing device F as the fixing portion and this is melt-fixed on the recording material P. The recording material P is passed through a sheet discharging path and is discharged on a sheet discharge tray, so that an output image of the image forming apparatus is obtained.

The recording material cassette 10 or the multi-tray 46 as a sheet feeding port of the image forming apparatus is provided with a paper width regulating guide (guiding member) for regulating a sheet feeding position (supply position) of the sheet (paper) with respect to the direction (widthwise direction) perpendicular to the sheet conveyance direction.

Figure 3:
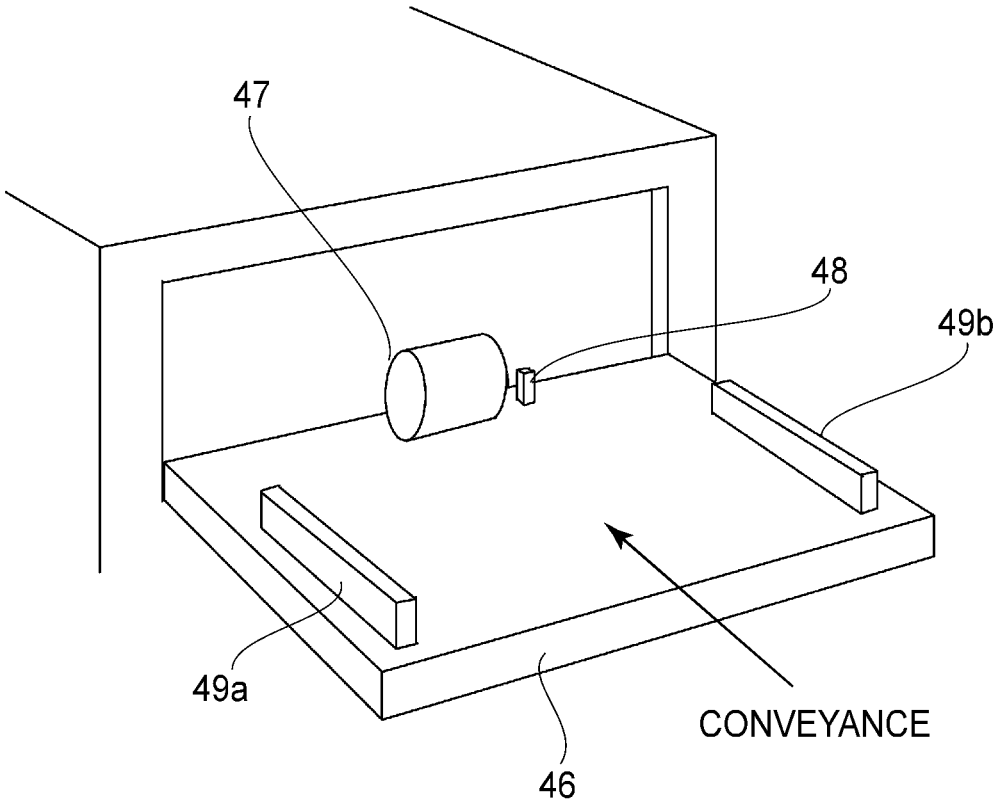
FIG. 3 is a perspective view of a multi-cassette in Embodiment 1.

FIG. 3 is a perspective view of the multi-tray as an example of the paper width regulating guide. The multi-tray includes a tray table 46 for holding the sheet, a sheet feeding roller 47, and a paper presence/absence sensor 48 for detecting the presence or absence of the sheet on the tray table 46. The paper width regulating guide consists of a pair of left and right plates 49*a* and 49*b* which are constituted so as to variably changing their relative positions with respect to the widthwise direction. By sliding these plates 49*a* and 49*b* correspondingly to the sheet size (width), the sheet can be conveyed by being aligned with a normal sheet passing reference position. The image forming apparatus in this embodiment employs the center reference (line) as a sheet passing reference (line) and therefore the paper width regulating guides 49*a* and 49*b* are always slidable in interrelation with the sheet so as to be equidistantly located from the center sheet passing reference position (conveyance reference position).

A movable (slidable) range of the paper width regulating guides is, in a state in which a distance (spacing) between these guides 49*a* and 49*b* is minimum, 75 mm so that a sheet (paper) of 3 inch×5 inch (76.2 mm×127 mm) as a minimum size of the sheet which is capable of being passed through the fixing device F. Further, in a state in which the distance is maximum, the movable range is 218 mm so that a sheet of LETTER size (216 mm×279 mm) as a maximum sheet passing size can be regulated by the guides 49*a* and 49*b*. The reason why the distance between the paper width regulating guides is made somewhat smaller than the minimum size of the sheet and somewhat larger than the maximum size of the sheet is that a dimensional tolerance of the sheet itself is taken into consideration.

(Fixing Device F)

Figure 4:
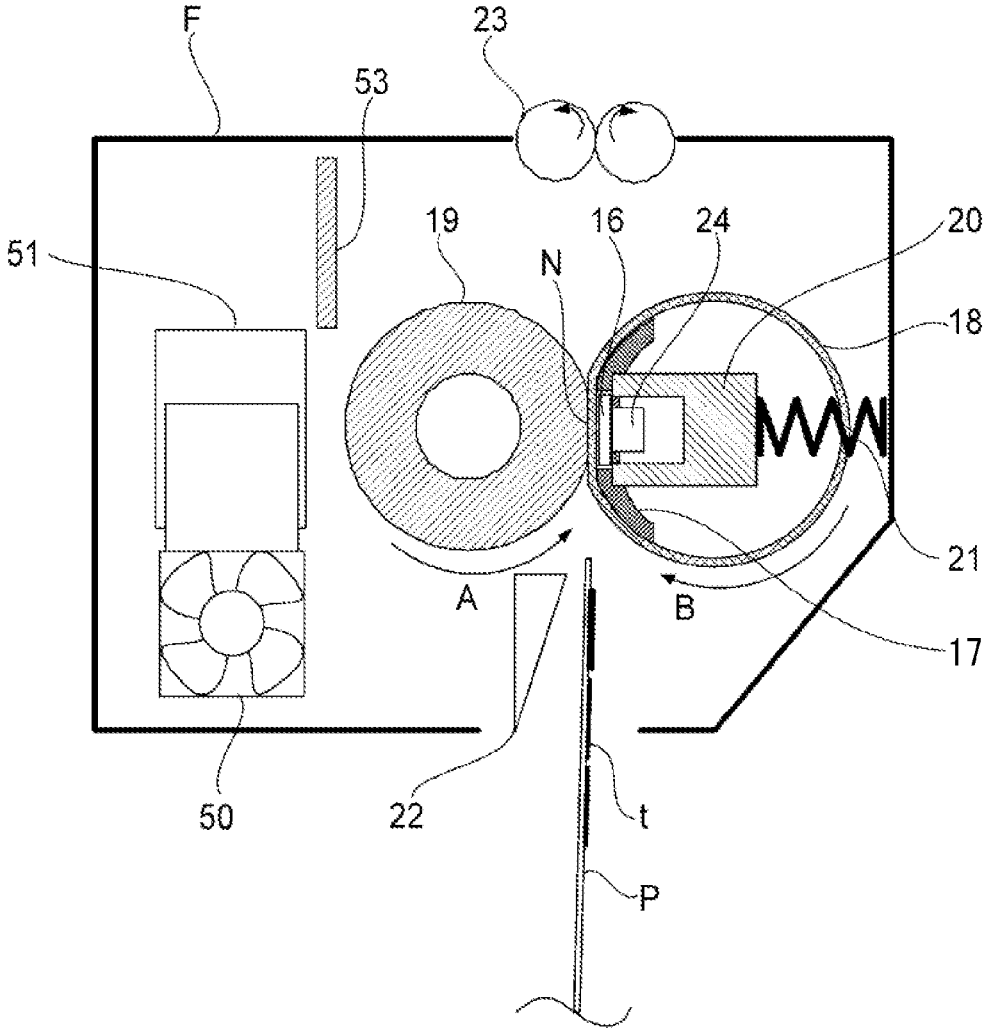
FIG. 4 is a schematic sectional view showing a structure of a fixing device in Embodiment 1.

FIG. 4 is a schematic sectional structural view of the fixing device F in this embodiment. The fixing device F in this embodiment is of a fixing film type and a rotatable pressing member drive type (tension-less type). The fixing device F includes a fixing film 18 as a first fixing member (rotatable member) which is a cylindrical (endless fixing-like) member prepared by providing an elastic layer on a film-like member. The fixing device F further includes a pressing roller 19 as a second fixing member (rotatable member), a heating means 16 (hereinafter referred to as a fixing heater), and a heater holder 17 which has heat resistance and rigidity and which is formed in a substantially semicircular trough shape in cross section. The fixing heater 16 is provided on a lower surface of the heater holder 17 along a longitudinal direction of the heater holder 17. The fixing film 18 is externally engaged loosely with the heater holder 17.

The heater holder 17 is formed of a liquid crystal polymer resin having a high heat resistance and has the function of holding the fixing heater 16 and guiding the fixing film 18. In this embodiment, as the liquid crystal polymer resin, a liquid crystal polymer ("Zenite (registered trademark) 7755, mfd. by DuPont). This liquid crystal polymer has a maximum usable temperature of about 270° C.

The pressing roller 19 is rotatably shaft-supported at both end portions of its core metal by front and rear side plates of a fixing device frame (not shown). As shown in FIG. 4, a heating assembly constituted by the fixing heater 16, the heater holder 17, the fixing film 18 and the like is disposed in parallel to the pressing roller 19 so that the fixing film 16 opposes the pressing roller 19. Both end portions of the heater holder 17 are urged in a direction perpendicular to the axial line of the pressing roller 19 with a pressure of 98 N (10 kgf) in one side, i.e., the pressure of 196 N (20 kgf) in total by an urging (pressing) mechanism constituted by an urging stay 20 provided inside the heater holder 17 and an urging spring 21 provided at both end portions of the urging stay 20. As a result, the fixing heater 16 is urged toward the pressing roller 19 against elasticity of the elastic layer of the pressing roller 19 so that the fixing film 18 is press-contacted to the pressing roller 19 with the predetermined urging force (pressure) to form a fixing nip N with a predetermined width necessary for heat-fixing. Further, the urging mechanism includes an unshown pressure-releasing mechanism to have a constitution in which the pressure is released (eliminated) during jam clearance or the like facilitate removal of the recording material P.

The pressing roller 19 is rotationally driven by an unshown driving means in the counterclockwise direction indicated by an arrow A at a predetermined peripheral speed. By this rotational driving of the pressing roller 19, a contact-frictional force in the fixing nip N between the outer surface of the pressing roller 19 and the fixing film 18 is generated, so that a rotational force acts on the cylindrical fixing film 18. As a result, the fixing film 18 is in a state in which it is rotated in the clockwise direction indicated by an arrow B around the heater holder 17 by the rotation of the pressing roller 19, while being intimately slid on the (left-hand) surface of the fixing heater 16 at its inner surface. On the inner surface of the fixing film 18, unshown grease is applied to ensure a sliding property between the heater holder 17 and the inner surface of the fixing film 18.

The pressing roller 19 is rotationally driven, whereby the cylindrical fixing film 18 is rotated. Further, the fixing heater 16 is supplied with electric power to be increased in temperature up to a predetermined temperature, thus being placed in a rising state (temperature-controlled state). In such a temperature-controlled state, into the film nip N between the fixing film 18 and the pressing roller 19, the recording material P carrying thereon an unfixed toner image t is guided and introduced along an entrance guide 22. Then, in the fixing nip N, a toner image carrying surface of the recording material P is intimately contacted to the outer surface of the fixing film 18, so that the recording material P is nip-conveyed through the fixing nip N together with the fixing film 18. In this nip-conveyance process, heat of the fixing heater 16 is supplied to the recording material P via the fixing film 18, so that the unfixed toner image t on the recording material P is melt-fixed under application of heat and pressure. The recording material P passing through the fixing nip N is curvature-separated from the fixing film 18 and then is discharged by a fixing discharging roller 23. In FIG. 4, as a cooling portion, a cooling fan 50 is provided and sends a cooling air to the fixing device F through a duct 51 as an air-blowing path.

Figure 5:
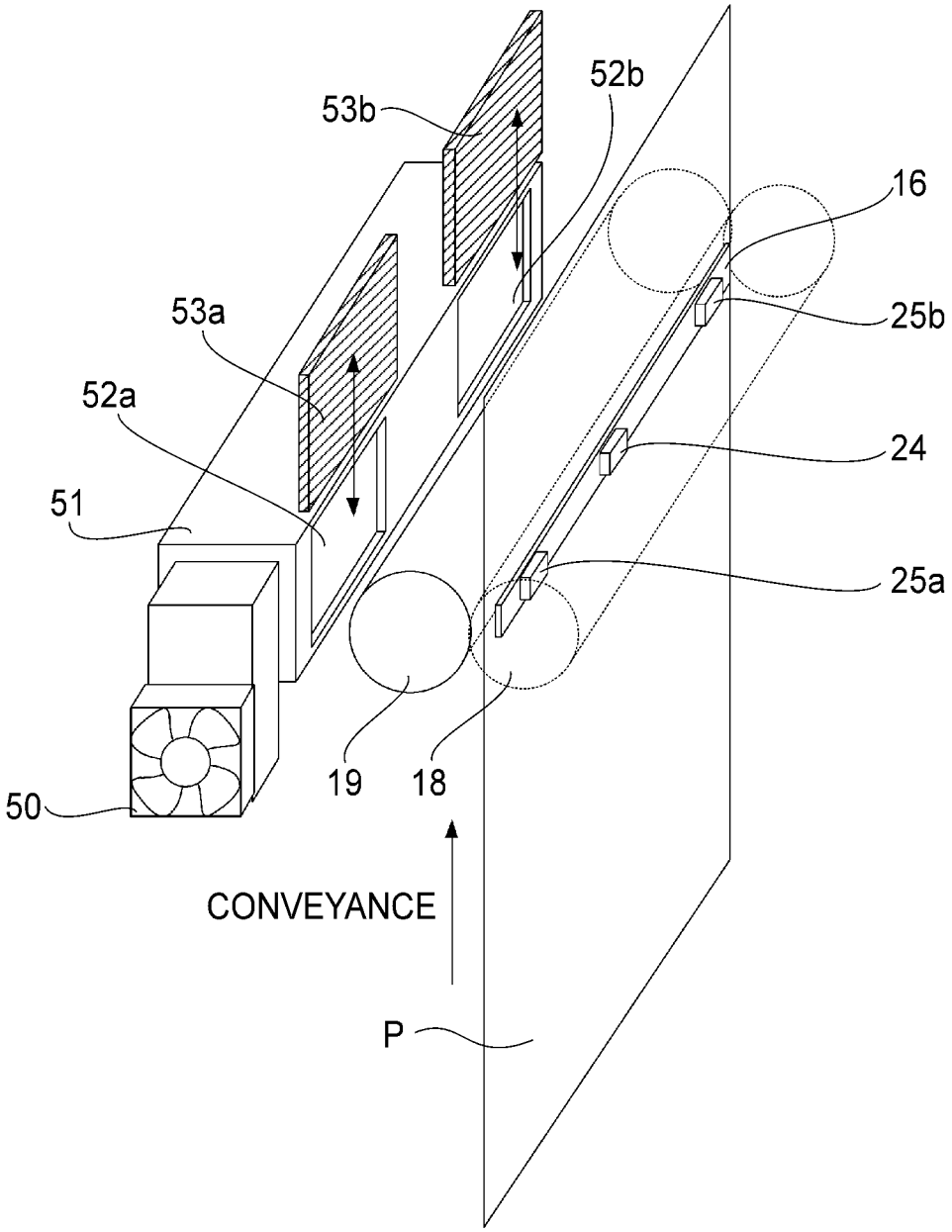
FIG. 5 is a perspective view of the fixing device in Embodiment 1.

FIG. 5 is a schematic perspective view showing a positional relation of parts of the fixing device F in this embodiment with respect to the longitudinal direction. As a temperature detecting means for detecting the temperature of the fixing heater 16, a main thermistor 24 is provided at a central portion of the fixing heater 16 as a heat source, and sub-thermistors 25*a* and 25*b* are provided at end portions within a maximum-sized sheet passing region (inside widthwise edges of the maximum-sized sheet). These main thermistor 24 and sub-thermistors 25*a* and 25*b* are disposed via an insulating member having (dielectric) withstand voltage so that each thermistor can ensure a distance for insulation from a heat generating member on the fixing heater 16. The duct 51 is provided with air-blowing openings 52*a* and 52*b* which are openable for sending the cooling air for cooling the pressing roller 19 to the neighborhood of both end portions of the pressing roller 19. At the air-blowing openings 52*a* and 52*b*, first and second shutters 53*a* and 53*b* which are independently openable (closable) are provided.

Figure 6:
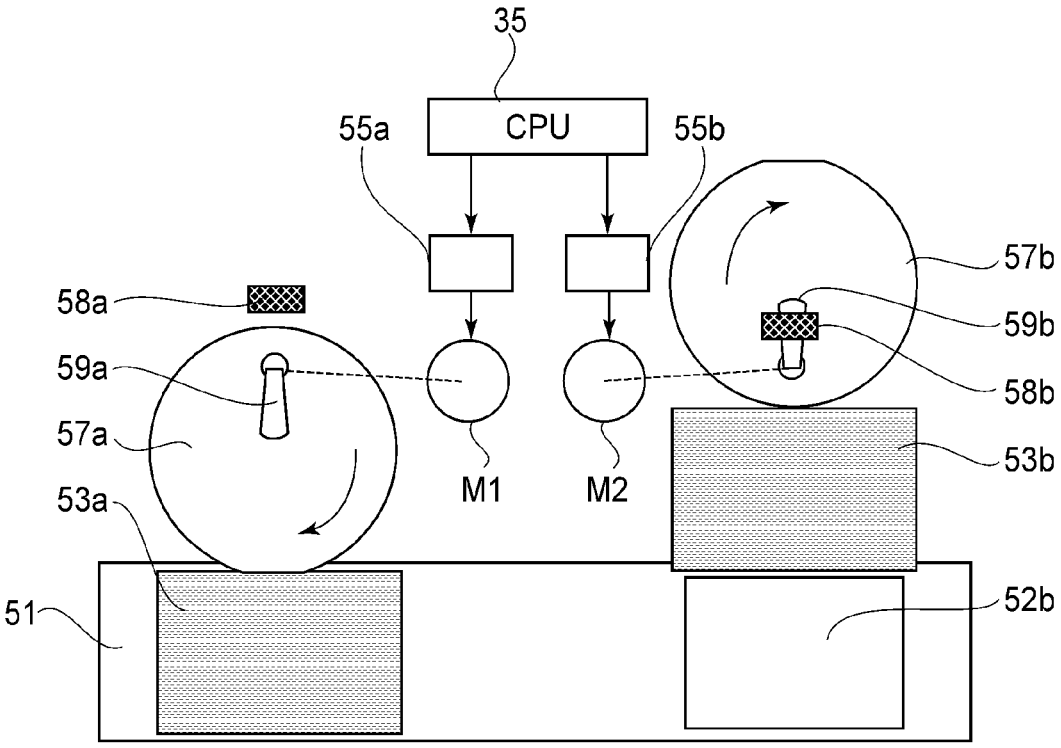
FIG. 6 is a simple structural view of a shutter mechanism in Embodiment 1.

FIG. 6 is a simple structural view of a shutter mechanism in this embodiment. As shown in FIG. 6, cams 57*a* and 57*b* for sliding the first shutter 53*a* and the second shutter 53*b* to open and close the air-blowing openings 52*a* and 52*b* are provided. To shafts for driving the cams 57*a* and 57*b*, shutter motors M1 and M2 are connected, respectively, via unshown gear trains. The motors M1 and M2 are a pulse motor and are driven in the number of predetermined steps by outputting phase signals from an engine controller (CPU) 35 via pulse motor driving circuits 55*a* and 55*b*, thus rotating the cams 57*a* and 57*b*. By the rotation of the cams 57*a* and 57*b*, the shutters 53*a* and 53*b* are independently slidable. Further, photo-interruptors 58*a* and 58*b* for detecting initial positions of the cams 57*a* and 57*b* (hereinafter, the photo-interruptors 58*a* and 58*b* are referred to as a home position sensor). For example, as the home position sensor, a photo-interruptor ("TLP1243" mfd. by Toshiba Corp.) may be used. In this embodiment, in the case where flags 59*a* and 59*b* rotating in synchronism with the cams 57*a* and 57*b* are located between an LED and a photo-transistor of the photo-interruptor, a "High" output is made. In the case where the flags 59*a* and 59*b* are not located between the LED and the photo-transistor, a "Low" output is made. Based on this output signals, the engine controller (CPU) 35 detects the positions of the shutters 53*a* and 53*b*.

In this embodiment, a constitution for cooling the pressing roller 19 is employed but the fixing film 18 or both of the pressing roller 19 and the fixing film 18 may also be cooled.

Figure 7:
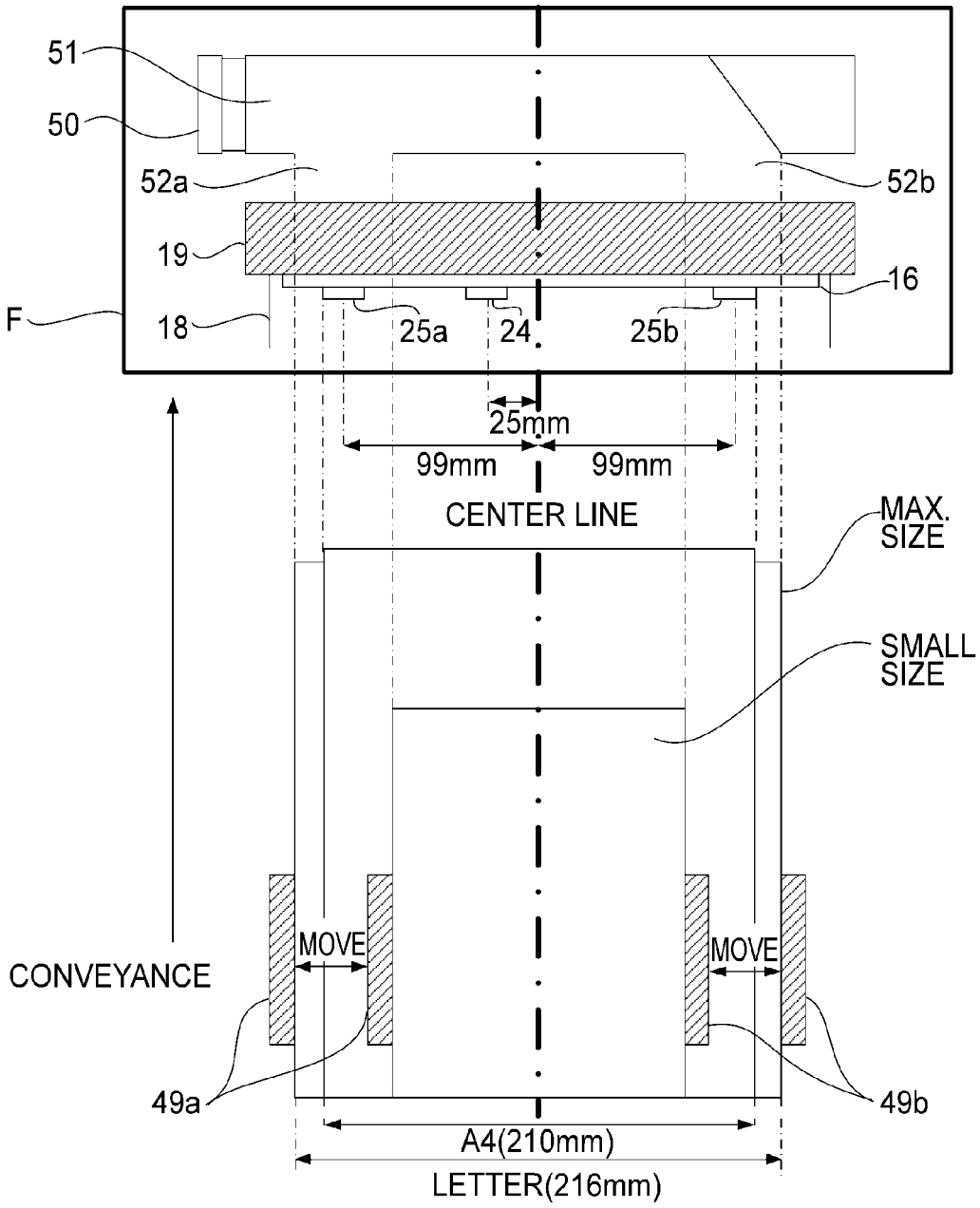
FIG. 7 is an arrangement view of thermistors and a duct with respect to a widthwise direction in Embodiment 1.

FIG. 7 shows the positional relation, with respect to the direction (widthwise direction) perpendicular to the recording material conveyance direction, among the main thermistor 24, the sub-thermistors 25*a* and 25*b*, the maximum-sized paper and small-sized paper that are conveyable through the sheet supplying opening, and the air-blowing openings 52*a* and 52*b* for the cooling air from the cooling fan 50. The main thermistor 24 is disposed so that the center thereof is located at a position of 25 mm leftward from the center reference position, so as to be always present within a sheet passing region even when a sheet (paper), conveyable through the fixing device, having any size, is passed through the fixing device. The sub-thermistors 25*a* and 25*b* are disposed at positions that are located within the sheet passing region of the maximum-sized paper and constitute a non-sheet-passing portion (where the recording material is not passed through the fixing device) when the small-sized paper is passed through the fixing device. The sub-thermistors 25*a* and 25*b* are disposed equidistantly from the center reference position in a bilaterally symmetrical manner. In FIG. 7, the left-hand sub-thermistor is denoted by reference characters 25*a* and the right-hand sub-thermistor is denoted by reference characters 25*b*. In this embodiment, paper smaller in size than A4-sized paper (of 210 mm in width) is treated as the small-sized paper, and therefore each sub-thermistor is disposed so that its center is located at a position of 99 mm from the center reference position. Whether or not recording material is treated as the small-sized paper varies depending on the image forming apparatus and therefore the position of each sub-thermistor from the center reference position varies depending on a target small-sized paper. When the small-sized paper is passed through the fixing device F, the non-sheet-passing portions of the fixing device F are increased in temperature, and therefore the sub-thermistors 25*a* and 25*b* directly detect these temperatures. Further, the sub-thermistors 25*a* and 25*b* are not used for the temperature control, but are used for detecting only an abnormal temperature rise of the fixing heater 16, such as non-sheet-passing portion temperature rise.

Similarly, the air-blowing openings 52*a* and 52*b* are also provided within the sheet passing region of the maximum-sized paper and at positions constituting the non-sheet-passing portions when the small-sized paper is passed through the fixing device F. Further, the air-blowing openings 52*a* and 52*b* are disposed at positions equidistantly from the center reference position in a bilaterally symmetrical manner. In this embodiment, the left-hand air-blowing opening is 52*a* and the right-hand air-blowing opening is 52*b*. In a normal operation, together with start of the rotation of the pressing roller 19 of the fixing device F, the rotation of the fixing film 18 is started, so that an inner surface temperature of the fixing film 18 is increased with an increasing temperature of the fixing heater 16. The electric power supplied to (inputted into) the fixing heater 16 is controlled so that a detection temperature of the main thermistor 24 is a target temperature (e.g., 195° C.).

(Control Means)

Figure 8:
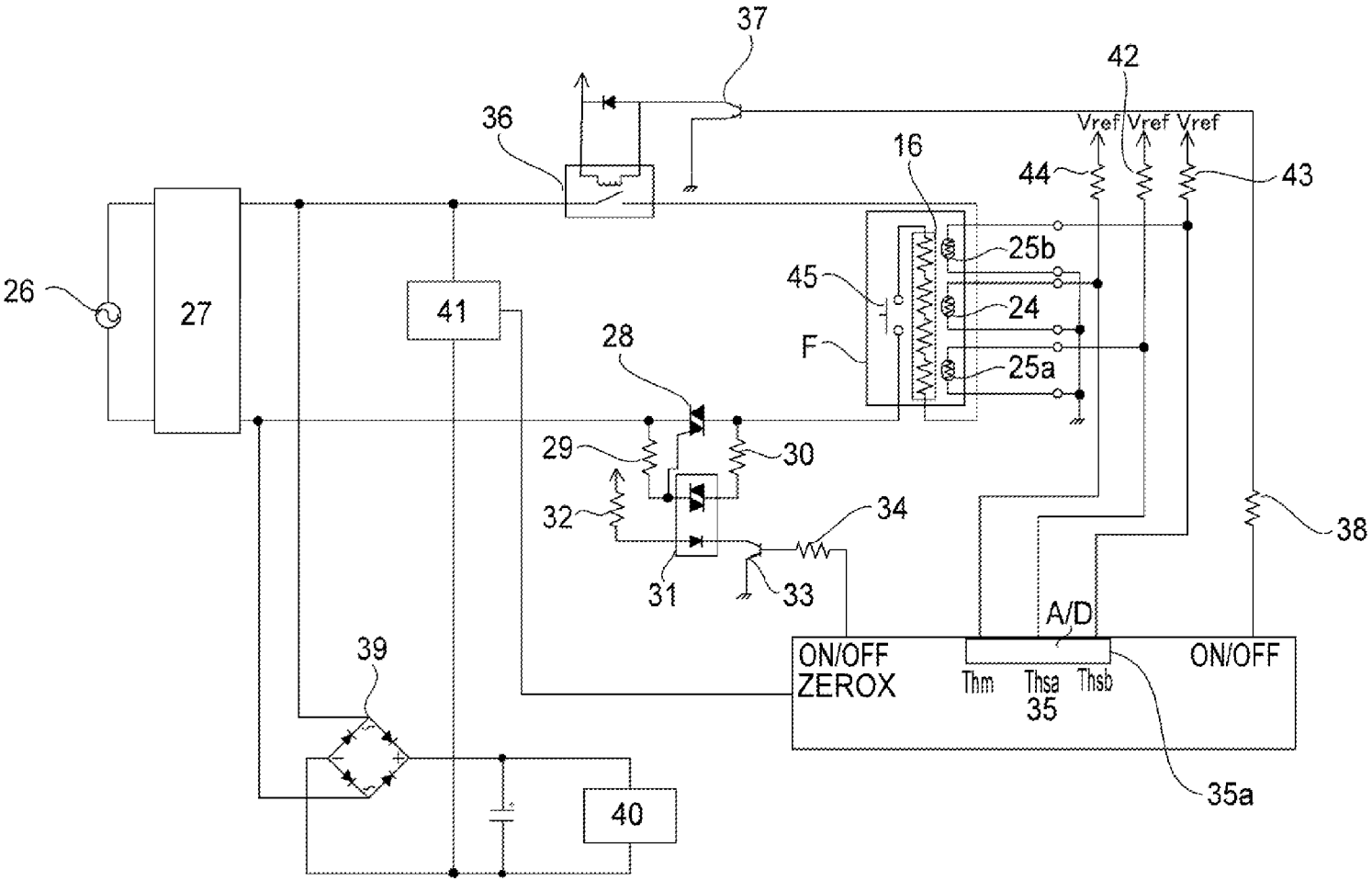
FIG. 8 is an electric circuit diagram of a heating controller in Embodiment 1.

With reference to FIG. 8, a circuit constitution as a control means for the fixing heater 16 in this embodiment will be described. In FIG. 8, an input commercial power source 26 connected to the image forming apparatus supplies the electric power to the fixing heater 16 via an AC filter 27, so that the fixing heater 16 generates heat. The electric power supply to the fixing heater 16 is controlled by turning on and off the electric power supply to a triac 28. Resistors 29 and 30 are bias resistors for the triac 28, and a photo-triac coupler 31 is a device for ensuring a creepage distance for insulation between primary and secondary portions. The triac 28 is supplied with the electric power by energizing a light emitting diode of the photo-triac coupler 31. A resistor 32 is a limiting resistor for limiting a current passing through the light emitting diode of the photo-triac coupler 31. The photo-triac coupler 31 is turned on and off by a photo-triac driving transistor 33.

The photo-triac driving transistor 33 is operated in accordance with an ON/OFF signal from the engine controller (CPU) 35 via a resistor 34. Further, the input commercial power source 26 via the AC filter 27 is interruptible by a relay 36, and the energization to and interruption of the energization to the relay 36 are controlled by a relay driving transistor 37. The relay driving transistor 37 is operated in accordance with an ON/OFF signal from the engine controller (CPU) 35 via a resistor 38. When the fixing heater 16 is heated, first the relay 36 is placed in an energization state and then the triac 28 is controlled to cause the fixing heater 16 to generate heat. Further, when the power source is turned off or placed in a sleep state or when the heat generation of the fixing heater 16 is stopped due to the occurrence of a jam or the like, the triac 28 is placed in an interruption state and thereafter the relay 36 is placed in the interruption state. Further, the input commercial power source 26 is branched in front of the relay 36 and is connected to a DC/DC converter 40 via a rectifying diode bridge 39.

A frequency detecting circuit 41 outputs a signal, including a point where the polarity of the voltage from the input commercial power source 26 is switched from positive to negative or from negative to positive, for notifying that the power source voltage is not more than a threshold (hereinafter, this signal is referred to as "ZEROX" waveform). This ZEROX waveform is a pulse signal whose signal cycle is substantially equal to a frequency of the input commercial power source 26. The engine controller (CPU) 35 detects a pulse edge of the ZEROX waveform to ON/OFF control the triac 28 by phase control or wave number opening.

Further, each of a divided voltage obtained by dividing a reference voltage Vref by a resistive value of main thermistor 24 and a voltage-dividing resistor 44, a divided voltage obtained by dividing a reference voltage Vref by a resistive value of sub thermistor 25*a* and a voltage-dividing resistor 42, and a divided voltage obtained by dividing a reference voltage Vref by a resistive value of sub-thermistor 25*b* and a voltage-dividing resistor 43 is inputted, as a temperature detecting signal, into an A/D converter 35*a* of the engine controller (CPU). The temperature detecting signal of the main thermistor 24 is abbreviated as Thm signal. The temperature of the fixing heater 16 is monitored, as the Thm signal of the main thermistor 24, by the engine controller (CPU) 35 and then was compared with a target temperature set inside the engine controller (CPU) 35. Then, electric power to be supplied to the fixing heater 16 is calculated and is converted into a phase angle (phase control) or a wave number (wave number control) corresponding thereto. Under an associated condition, the engine controller (CPU) 35 sends an ON signal to the photo-triac driving transistor 33.

In the case where the electric power supply control means goes out of order and the fixing heater 16 exhibits thermal runaway when the electric power is supplied to the fixing heater 16, as one of means for preventing overheating, an overheating preventing means 45 is provided on the fixing heater 16. The overheating preventing means 45 is, e.g., a temperature fuse or a thermo-switch. Due to the failure of the electric power supply control means, when the fixing heater 16 exhibits the thermal runaway and the overheating preventing means 45 reaches not less than a predetermined temperature, the overheating preventing means 45 breaks in the case of the temperature fuse or is in an open state in the case of the thermo-switch, thus interrupting the energization to the fixing heater 16.

(Cooling Control Sequence During Lateral Shifting Sheet Passing)

Figure 9:
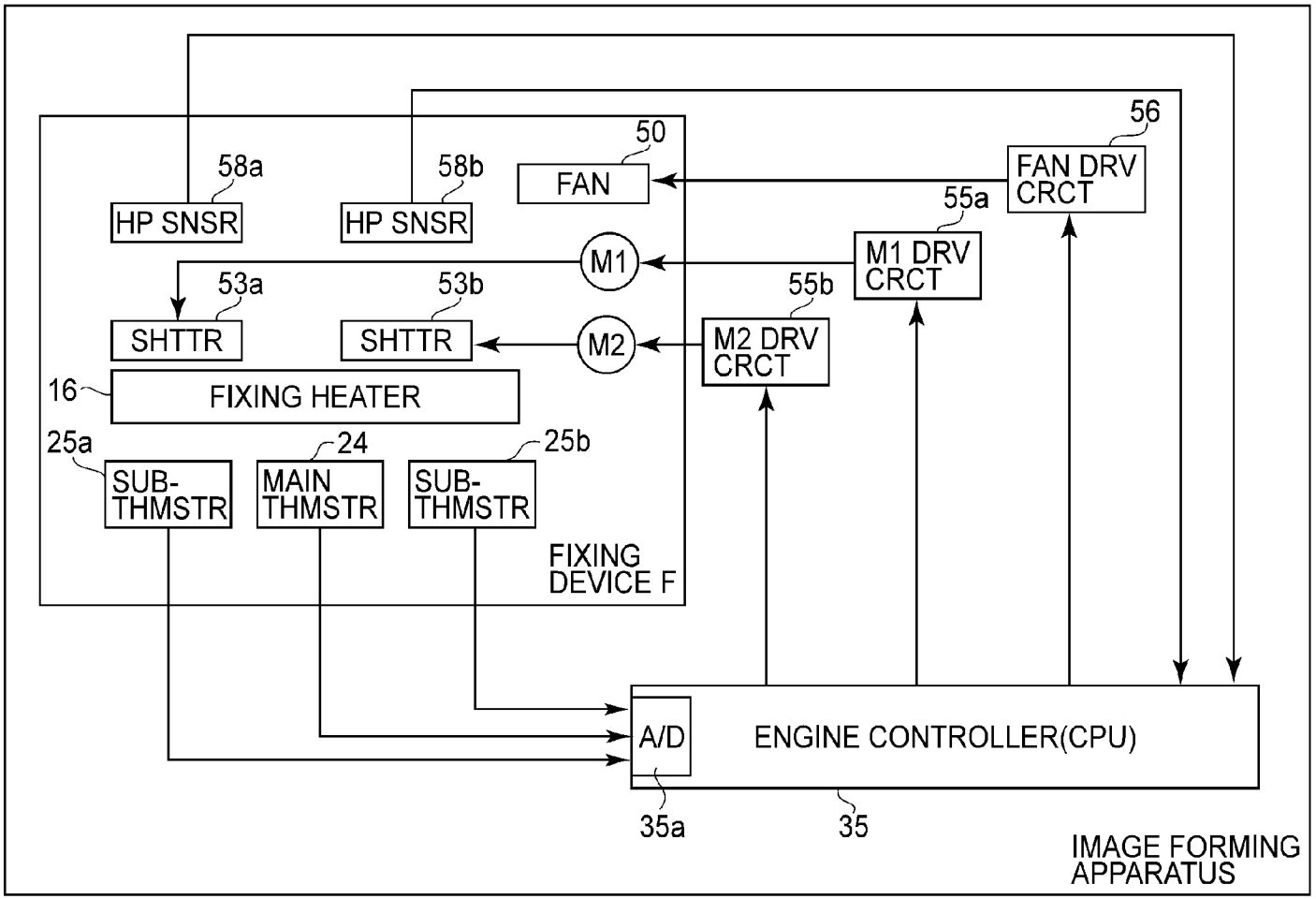
FIG. 9 is a block diagram of thermistors, cooling fans and a shutter control system in Embodiment 1.
Figure 10:
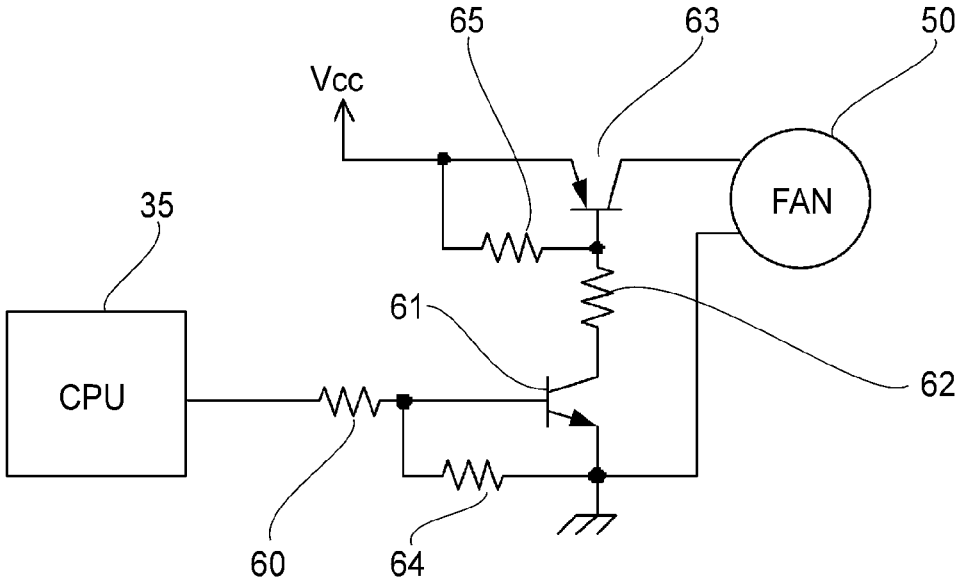
FIG. 10 is a fan drive circuit diagram in Embodiment 1.

With reference to a block diagram of FIG. 9, a constitution of cooling control during lateral shifting sheet passing will be described. During printing, temperature signals detected from the main thermistor 24 and sub-thermistors 25*a* and 25*b* for detecting the temperatures of the fixing heater 16 are inputted into the A/D converter 35*a* in the engine controller (CPU) 35. At this time, in the case of lateral shifting sheet passing, either one of the sub-thermistors 25*a* and 25*b* is increased in temperature. In the case where the sub-thermistor is continuously increased in temperature and the temperature exceeds a predetermined temperature, in order to close the shutter 53*a* or 53*b* in a side opposite from the side where the temperature is increased, the engine controller (CPU) 35 controls a shutter motor driving circuit 55*a* or 55*b* to drive a shutter motor M1 or M2. At this time, the engine controller (CPU) 35 checks the position of the shutter on the basis of a detection result of a home position sensor 58*a* and 58*b*. After the shutter is closed, a cooling fan driving circuit 56 is controlled to drive a fan 50. In this embodiment, the cooling fan driving circuit 56 is as shown in FIG. 10 and is capable of driving the fan 50 by outputting an ON/OFF signal from the engine controller (CPU) 35. As a specific circuit operation, when the "High" signal is outputted from the engine controller (CPU) 35, a transistor 61 is turned on by a current passing through the circuit via a resistor 60. When the transistor 61 is turned on, a transistor 63 connected to a collector of the transistor 61 via a resistor 62 is turned on, so that a voltage, lowered from a power source voltage Vcc by a voltage corresponding to a saturation voltage Vice of the transistor 63, is applied to the fan 50. Thus, the fan 50 is operated at the rotation number depending on the applied voltage. Further, when the "Low" signal or high impedance is outputted from the engine controller (CPU) 35, the voltage is pulled down to the ground (GND) potential by a resistor 64, so that the transistor 61 is turned off. A voltage pulled up to the power source voltage Vcc via a resistor 65 is applied to the transistor 63, so that the transistor 63 is turned off and the fan 50 is not supplied with the voltage and is not driven.

Figures 1, 1A:
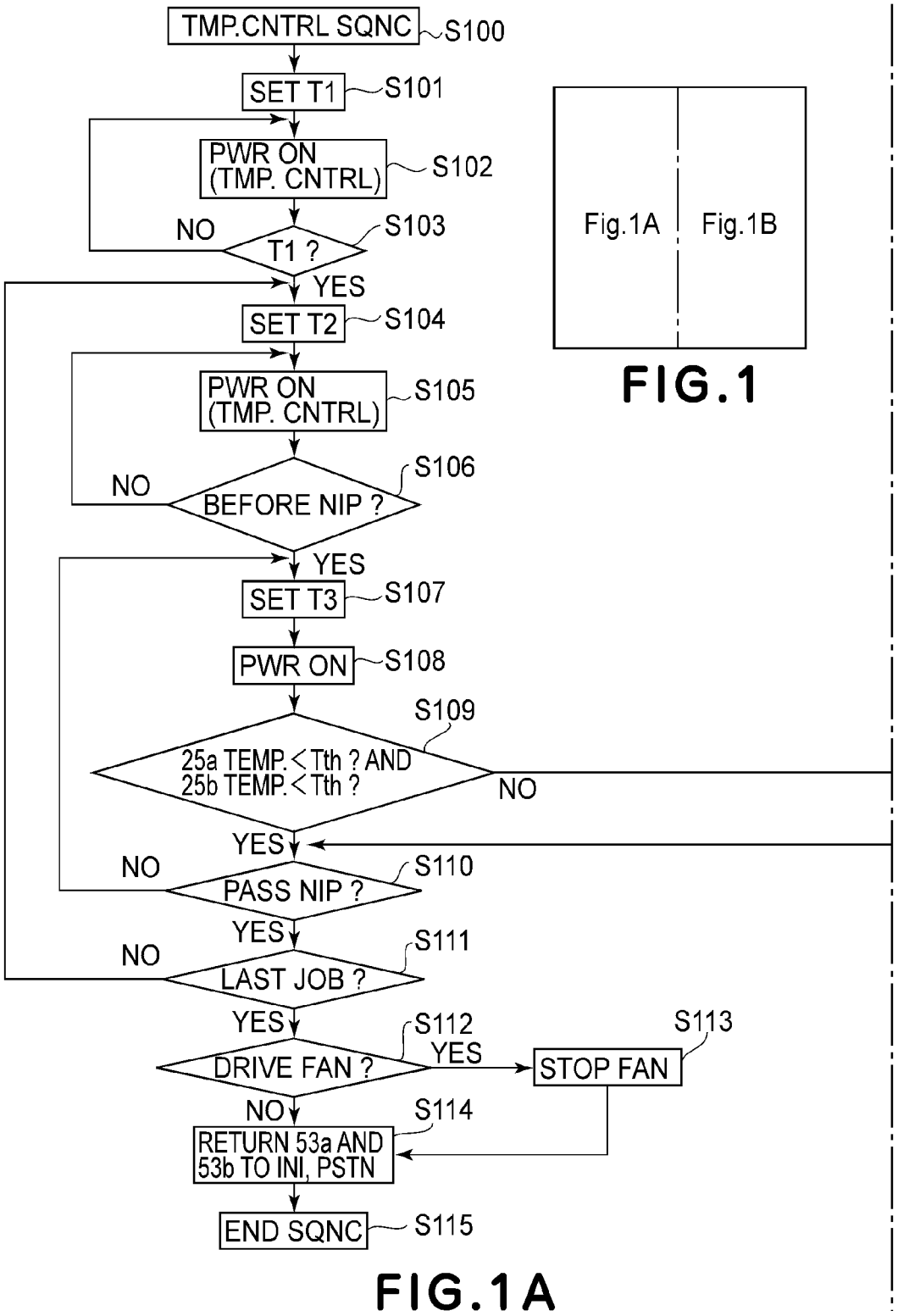
FIGS. 1A and 1B are flow charts showing a cooling control sequence during lateral shifting sheet passing in Embodiment 1.

A cooling control sequence during lateral shifting sheet passing in this embodiment will be described with respect to a flow chart shown in FIGS. 1A and 1B. A fixing temperature control sequence is started by the engine controller (CPU) 35 (S100). The engine controller (CPU) 35 sets a target temperature T1 during rising in order to actuate the fixing device F (S101), and then calculates the necessary electric power from the difference between the temperature of the main thermistor 24 and the target temperature T1 and supplies the electric power to the fixing heater 16 (S102). Next, the engine controller (CPU) 35 discriminates whether the temperature reaches the target temperature T1 during rising (S103). The electric power supply is repeated until the temperature reaches the target temperature T1 (NO of S103 and S102), and when the temperature reaches the target temperature (YES of S103), the target temperature is set at a necessary (temperature-)control temperature until paper enters the fixing nip (S104). Then, the engine controller (CPU) 35 calculates the necessary electric power from the current temperature of the main thermistor 24 and the target temperature T2 and supplies the electric power to the fixing heater 16 (S105). Then the engine controller (CPU) 35 discriminates whether or not timing of the recording material P is immediately before the recording material P enters the fixing nip (S106). The electric power supply is repeated until the timing of the recording material P is immediately before the recording material P enters the fixing nip (NO of S106 and S105). When the timing is immediately before the recording material P enters the fixing nip (YES of S106), the target temperature is set at a target temperature T3 necessary for fixing the toner image on the recording material P (S107). Then, from the difference between the current temperature of the main thermistor 24 and the target temperature T3, the necessary electric power is calculated and is supplied to the fixing heater 16 (S108). Further, the target temperatures T1, T2 and T3 satisfy a relationship of T1<T2<T3. The reason why the target temperature is increased up to the target temperature T3 immediately before the recording material P enters the fixing nip is that an image defect, due to the taking of heat by the recording material P when the recording material carrying thereon the toner image enters the fixing nip, is avoided.

The above sequence is the same irrespective of the paper size and lateral shifting sheet passing but the following sequence varies depending on the paper size and a sheet passing state. In this embodiment, only the case where the small-sized paper is subjected to the lateral shifting sheet passing will be described.

Figure 11:
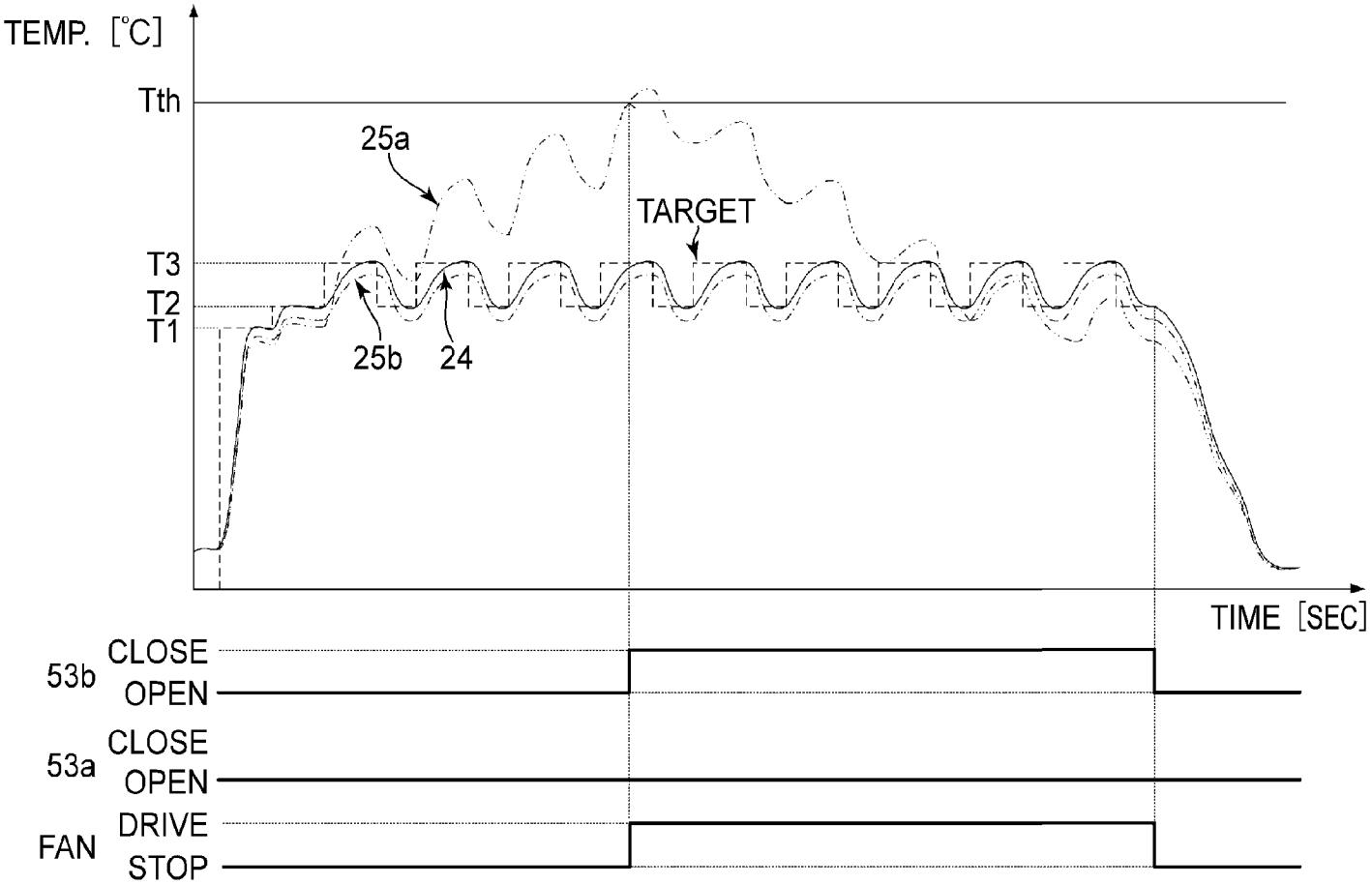
FIG. 11 is a time chart of a thermistor temperature change and drive of shutters and the fan in Embodiment 1.
Figure 12:
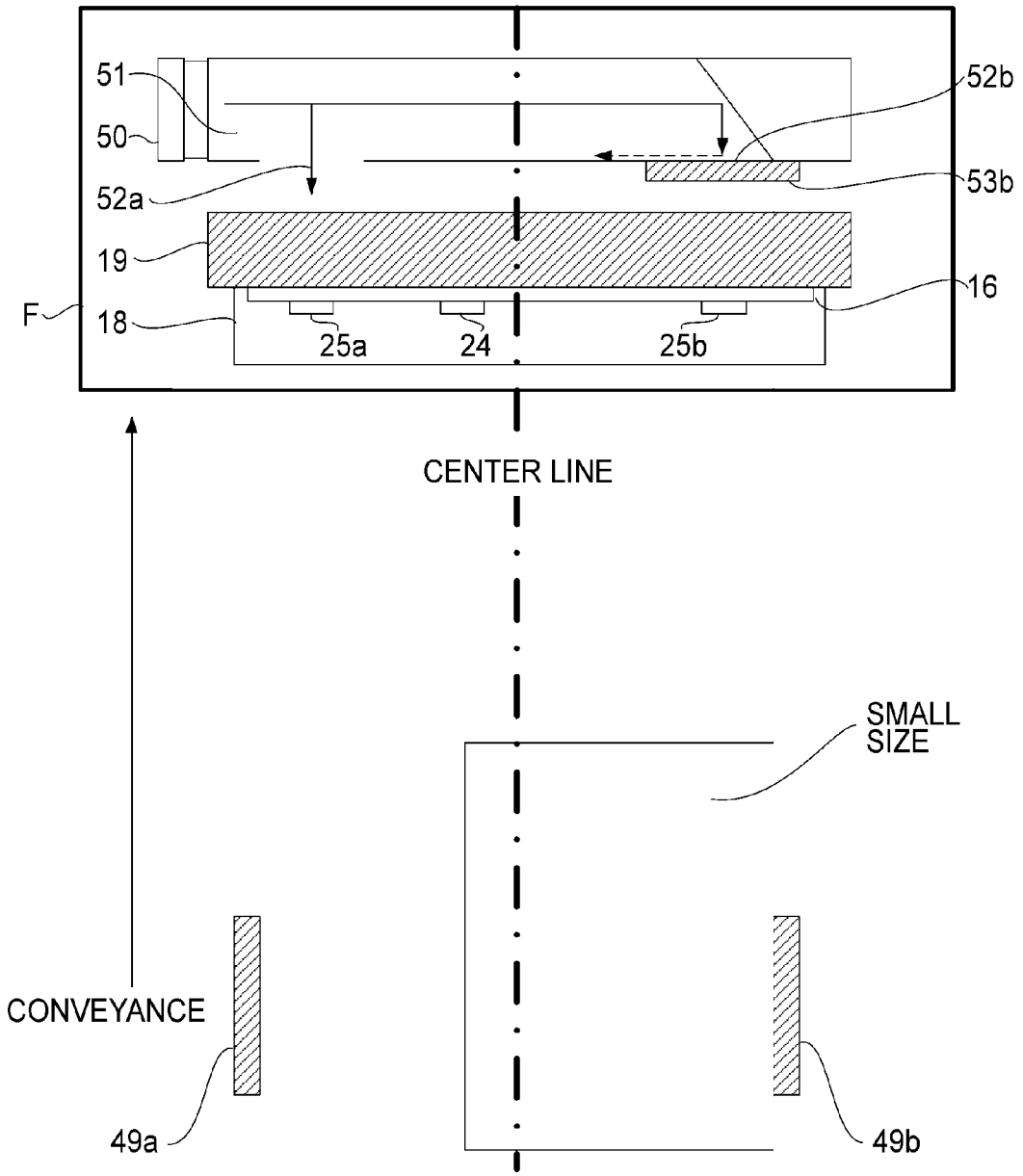
FIG. 12 is an arrangement view of a small-sized paper and the shutter with respect to a widthwise direction in Embodiment 2.

FIG. 11 shows a temperature change with time of the main thermistor 24 and the sub-thermistor 25*a* and 25*b* by taking, as an example, the case where the small-sized paper is subjected to the lateral shifting sheet passing on the side where the sub-thermistor 25*b* is provided. FIG. 12 shows a lateral shifting direction of the small-sized paper and a state of the shutter 53*b*. As shown in FIG. 11, when the small-sized paper is subjected to the lateral shifting sheet passing, the temperature of the sub-thermistor 25*a* on the side where the small-sized paper is not subjected to the lateral shifting sheet passing is increased. Then, when the temperature of the sub-thermistor 25*a* reaches a predetermined threshold Tth, with timing in S109 of the flow chart of FIG. 1A, a condition of: (sub-thermistor 25*a* temperature)<Tth and (sub-thermistor 25*b* temperature)<Tth is not satisfied. In the case where this condition is not satisfied, the engine controller (CPU) 35 discriminates whether or not a condition of: (sub-thermistor 25*a* temperature)≥Tth and (sub-thermistor 25*b* temperature) <Tth is satisfied (S116 in FIG. 1B). In this example, this condition is satisfied and therefore the engine controller (CPU) 35 checks whether or not the shutter 53*b* closes the air-blowing opening 52*b* (S117). In the case where the shutter 53*b* does not close the air-blowing opening 52*b*, the shutter 53*b* is driven to close the air-blowing opening 52*b* (S118) and then the engine controller (CPU) 35 checks whether or not the fan is driven (S119). In the case where the fan is not driven, the fan is driven (S120) and then the engine controller (CPU) 35 checks whether or not a trailing end of the recording material P passes through the fixing nip (S110). In the case where the trailing end of the recording material P does not pass through the fixing nip, the sequence is returned to S107, in which the temperature control is repeated during the sheet passing. When the passing of the trailing end of the recording material P through the fixing nip is detected, the engine controller (CPU) 35 checks whether or not a subsequent recording material for printing is present (S111). When there is no subsequent recording material, the engine controller (CPU) 35 checks whether or not the fan is driven (S112). When the fan is driven, the fan is stopped (S113), and then the shutters 53*a* and 53*b* are returned to their initial positions (S114). Then, the fixing sequence is ended (S115).

Figure 1B:
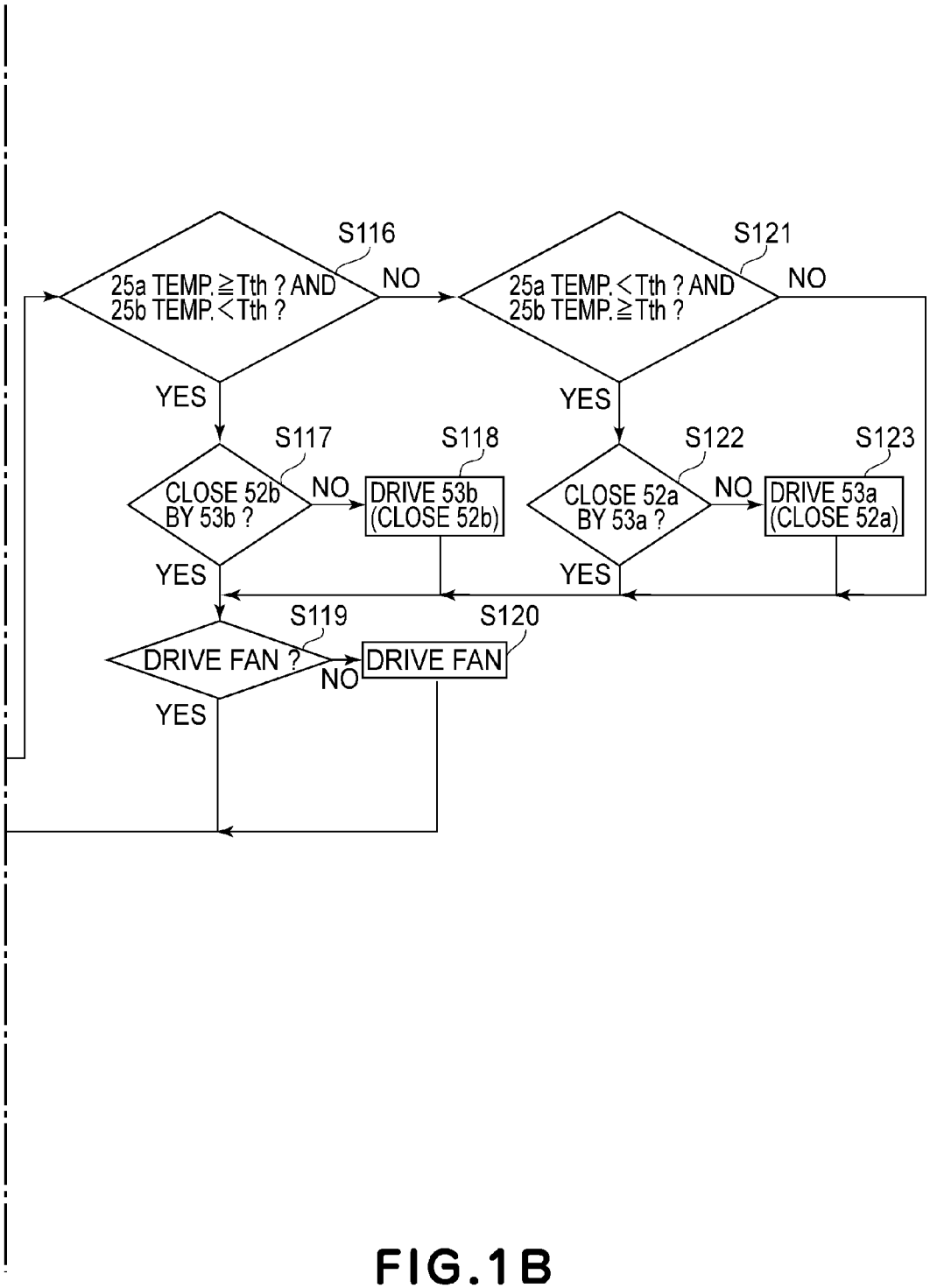

Further, in the case where the small-sized paper is subjected to the lateral shifting sheet passing in the side, where the sub-thermistor 25*a* is provided, opposite from the side where the sub-thermistor 25*b* is provided, with timing in S116 of the flow chart of FIG. 1B, the condition of: (sub-thermistor 25*a* temperature)≥Tth and (sub-thermistor 25*b* temperature)<Tth is not satisfied. In this case, the engine controller (CPU) 35 discriminates whether or not a condition of: (sub-thermistor 25*a* temperature)<Tth and (sub-thermistor 25*b* temperature)≥Tth is satisfied (S121). In the case where the small-sized paper is subjected to the lateral shifting sheet passing in the sub-thermistor 25*a* side, this condition is satisfied and therefore the engine controller (CPU) 35 checks whether or not the shutter 53*a* closes the air-blowing opening 52*a* (S122). In the case where the shutter 53*a* does not close the air-blowing opening 52*a*, the shutter 53*a* is driven to close the air-blowing opening 52*a* (S123) and then the engine controller (CPU) 35 checks whether or not the fan is driven (S119). In the case where the fan is not driven, the fan is driven (S120) and then the engine controller (CPU) 35 checks whether or not a trailing end of the recording material P passes through the fixing nip (S110).

In the case where the condition in S121 is not satisfied, the engine controller (CPU) 35 discriminates that the temperatures of the sub-thermistors 25*a* and 25*b* provided on both sides are increased and then checks whether or not the fan is driven without closing both ducts (S119). When the fan is not driven, the fan is driven (S120). The control after S120 is the same as that in the case where the small-sized paper is subjected to the lateral shifting sheet passing in the sub-thermistor 25*b* side.

In the control in this embodiment, a sequence is performed in which the fan is driven when the sub-thermistor temperature exceeds the threshold temperature Tth, and then is continuously driven until the job is ended. However, control such that the driving of the fan is stopped when the sub-thermistor temperature is lowered to some extent may also be effected. That is, control with hysteresis with respect to the threshold temperature for determining ON/OFF of the fan drive may be effected.

Further, during the lateral shifting sheet passing, the region of the non-sheet-passing portion is larger than when the small-sized paper is passed through the fixing nip at the center conveyance reference position, i.e., when the small-sized paper is passed through the fixing nip in a state in which the widthwise center of the small-sized paper substantially coincides with the center conveyance reference position, so that a degree of the non-sheet-passing portion temperature rise becomes large. Therefore, there is a need to cool the fixing heater 16 by increasing an air flow rate compared with that during a normal operation. Thus, in the case where the lateral shifting sheet passing is detected, control such that the air flow rate is increased in a predetermined degree may also be effected.

Further, in the case where the sub-thermistor temperature is not lowered but is increased even when the above control is effected, in addition, control such that a second threshold temperature Tth2 is provided and the air flow rate of the fan is increased when the sub-thermistor temperature reaches the second threshold temperature Tth2 may also be effected.

In this embodiment, an example in which the ceramic heater is used as the fixing portion is described but the heat source may also be an induction heating means or a halogen heater.

As in this embodiment, when the temperature detecting means (sub-thermistors) are disposed at the non-sheet-passing portions, whether or not the non-sheet-passing portion temperature reaches a destruction (fracture) temperature is directly detected, and therefore safety can be further enhanced. Further, control such that the air flow rate of the fan is switched, depending on the non-sheet-passing portion temperature or that the fan drive is stopped when the non-sheet-passing portion temperature is excessively lowered is effected, makes it possible to provide an image forming apparatus that is even safer and does not impair the safety.

In this embodiment, the air-blowing opening where the first shutter 53*a* and the opening 52*a* are provided is a first cooling portion, and the air-blowing opening where the second shutter 53*b* and the opening 52*b* are provided is a second cooling portion. Thus, in this embodiment, with respect to the direction perpendicular to the recording material conveyance direction, the first cooling portion for cooling one of end portion regions of the fixing portion and the second cooling portion for cooling the other end portion region are provided and are drivable independently. In this embodiment, the first shutter 53*a* and the second shutter 53*b* are operable independently from each other. Further, in the case where the recording material to be conveyed in the fixing nip is shifted in the direction perpendicular to the recording material conveyance direction to cause a temperature difference between the one end portion region and the other end portion region, at the cooling portion corresponding to the higher-temperature end portion region, the shutter is located at the position where the opening is open. At the other end portion region, the shutter is located at the position where the opening is closed.

Embodiment 2

In Embodiment 1, the cooling of the fixing device is performed by the single fan but this embodiment is different from Embodiment 1 in that two fans are separately driven to cool the end portion regions of the fixing device. The image forming apparatus in this embodiment has the same mechanical constitution as that of the image forming apparatus in Embodiment 1 except for the constitution of the cooling fan for the fixing device, thus being omitted from the description. In the following, the cooling fan arrangement and the cooling control sequence during lateral shifting sheet passing will be described in this order. Portions or means of the fixing device which have the same functions as those of the fixing device in Embodiment 1 are represented by the same reference numerals or symbols.

(Cooling Fan Arrangement)

Figure 13:
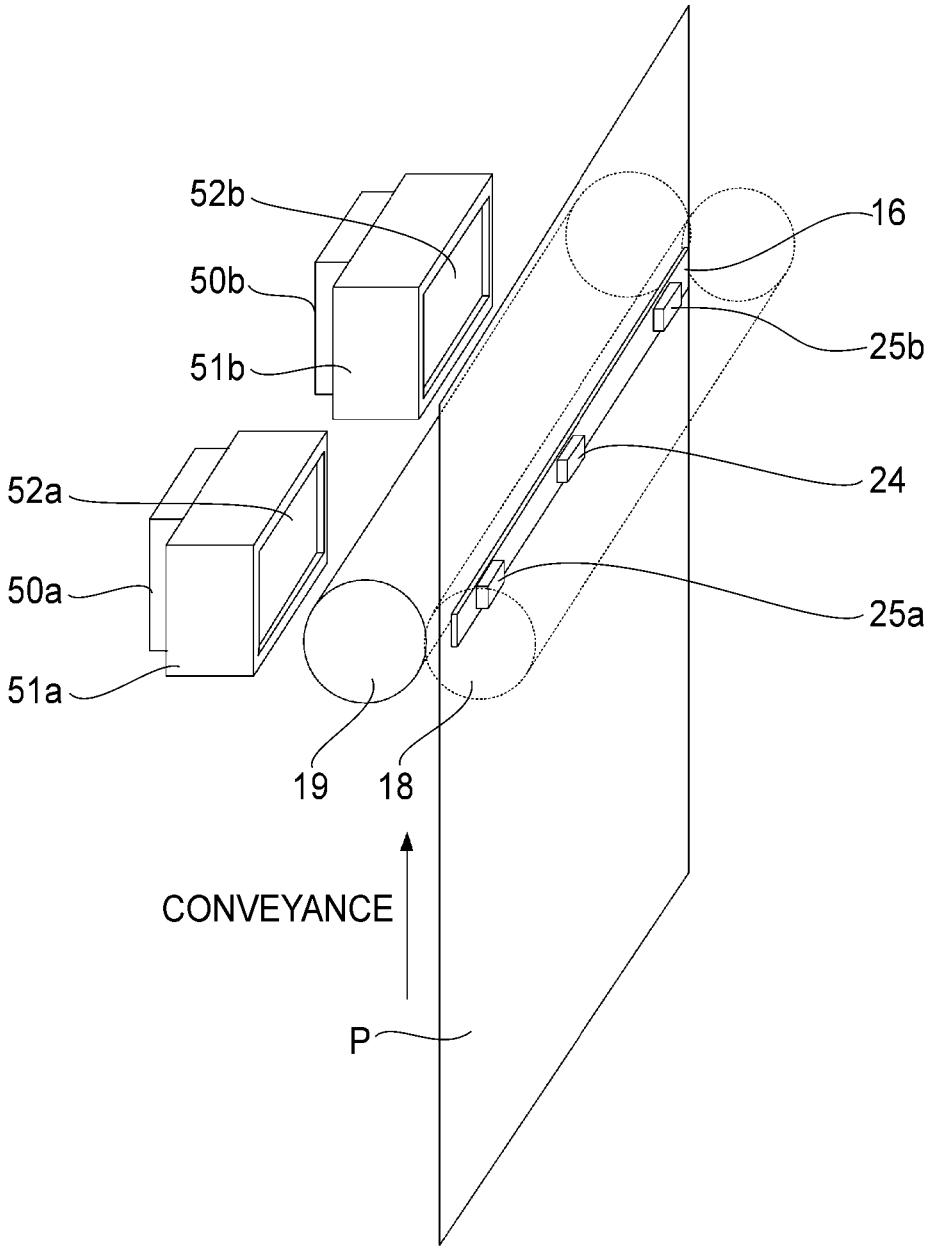
FIG. 13 is a perspective view of a fixing device in Embodiment 2.

FIG. 13 is a schematic perspective view showing a positional relation among parts of the fixing device F in this embodiment with respect to the longitudinal direction. Fans 50*a* and 50*b* as parts of the cooling portion in this embodiment are provided and are separately drivable by an unshown driving circuit. Ducts 51*a* and 51*b* constituting air-blowing paths through which the cooling air from the first and second cooling fans 50*a* and 50*b* is sent to the fixing device F are also provided. The ducts 51*a* and 51*b* are provided with air-blowing openings 52*a* and 52*b*, respectively, for cooling the pressing roller 19.

Figure 14:
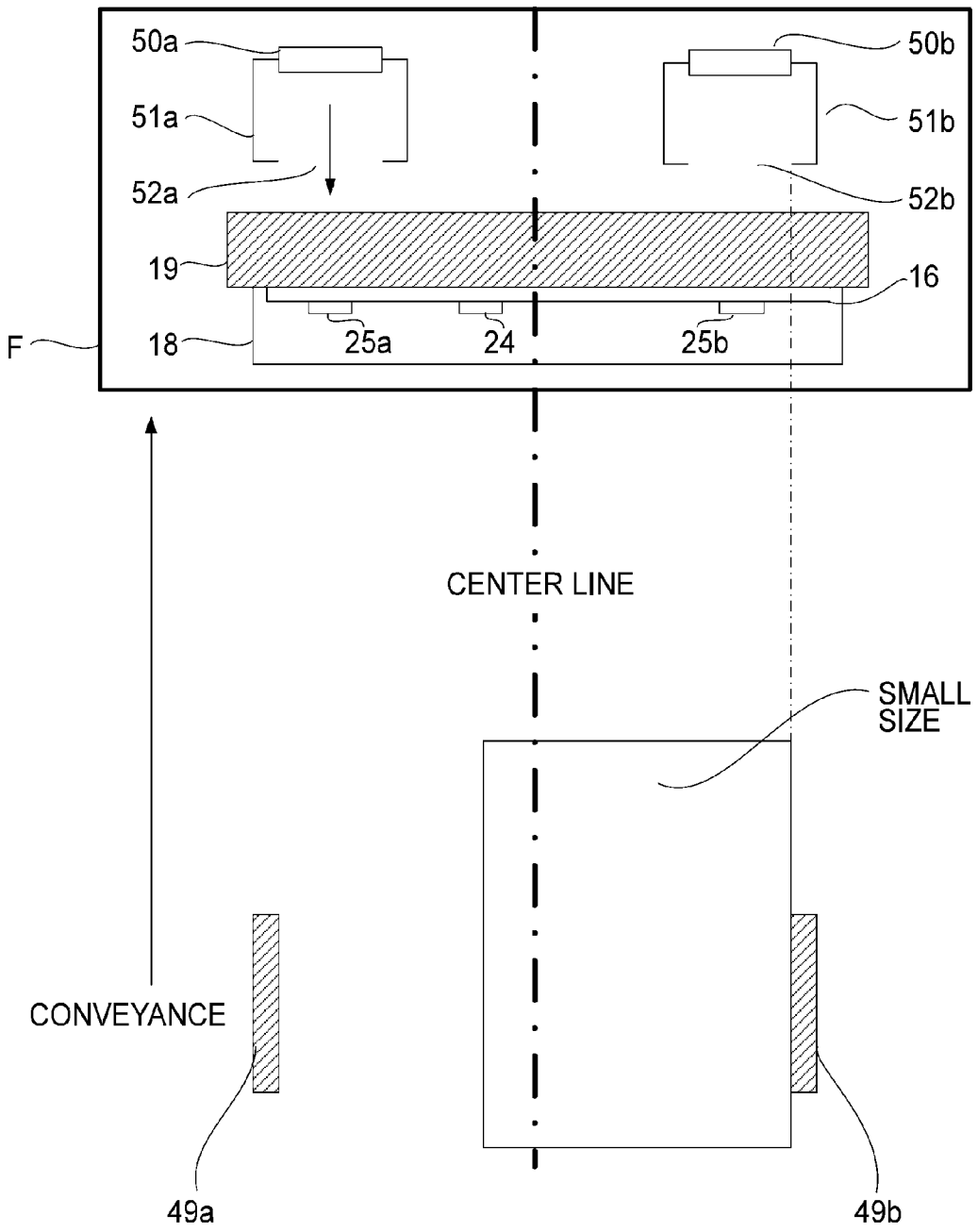
FIG. 14 is an arrangement view of thermistors and a dust with respect to the widthwise direction in Embodiment 2.

FIG. 14 shows a positional relation, with respect to the widthwise direction perpendicular to the recording material conveyance direction in the fixing device F, among the main thermistor 24, the sub-thermistors 25*a* and 25*b*, the maximum-sized paper and the small-sized paper which are conveyable through the sheet feeding port, the cooling fans 50*a* and 50*b* and the air-blowing openings 52*a* and 52*b* for the cooling air. The arrangement relation among the main thermistor 24, the sub-thermistors 25*a* and 25*b* and the air-blowing openings 52*a* and 52*b* is the same as that in Embodiment 1 and therefore will be omitted from the description.

(Cooling Control Sequence During Lateral Shifting Sheet Passing)

Figure 15:
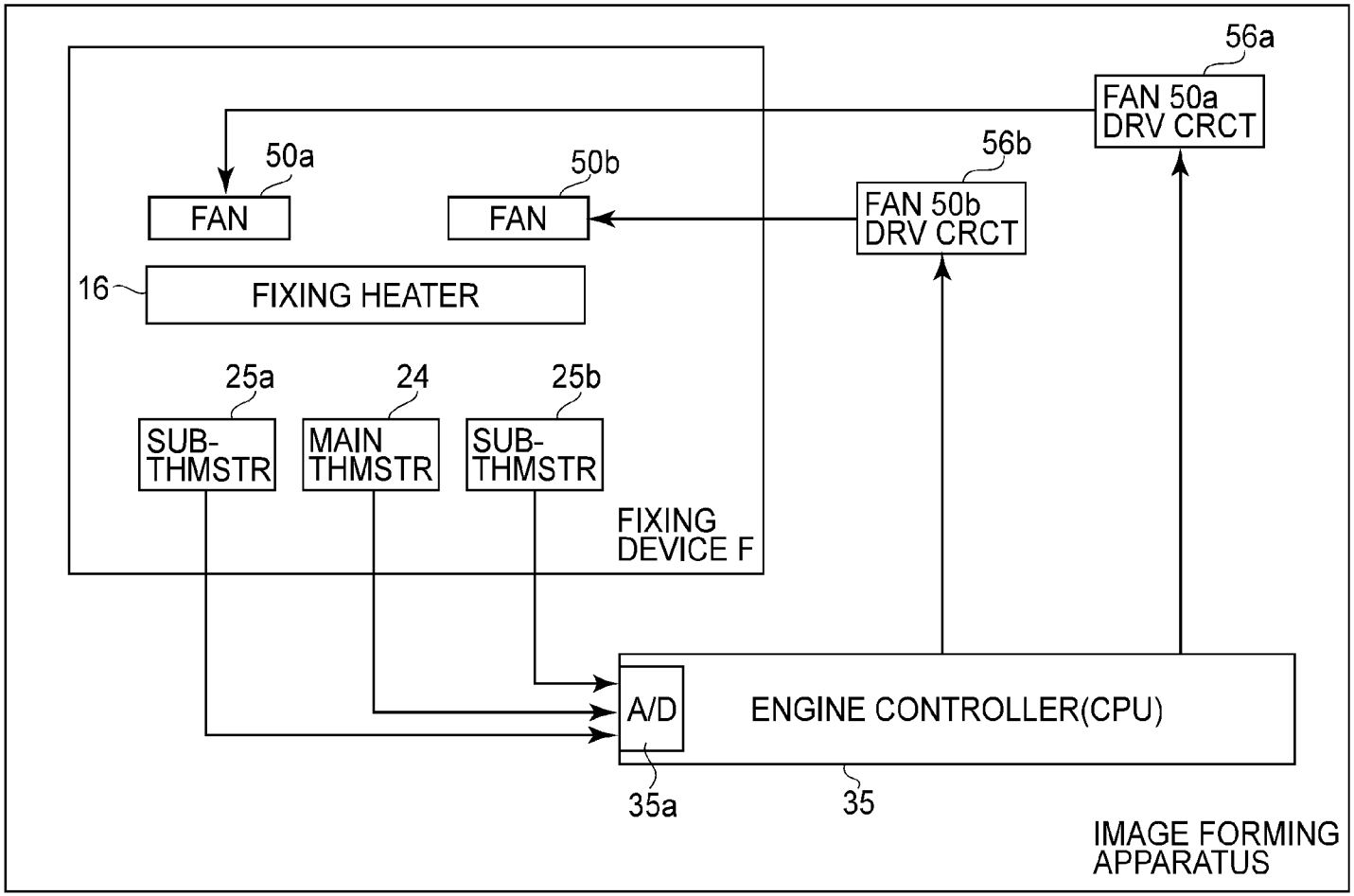
FIG. 15 is a block diagram of a control system for cooling fans and thermistors in Embodiment 2.
Figure 16:
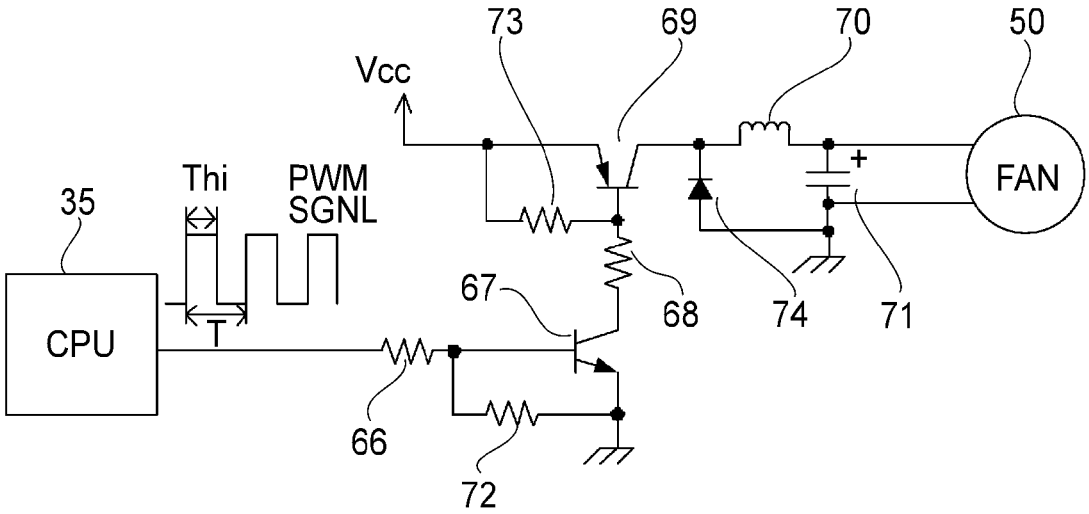
FIG. 16 is a fan drive circuit diagram in Embodiment 2.

With reference to a block diagram of FIG. 15, a constitution of cooling control during lateral shifting sheet passing will be described. During printing, temperature signals detected from the main thermistor 24 and sub-thermistors 25*a* and 25*b* for detecting the temperatures of the fixing heater 16 are inputted into the A/D converter 35*a* in the engine controller (CPU) 35. At this time, in the case of lateral shifting sheet passing, either one of the sub-thermistors 25*a* and 25*b* is increased in temperature. In the case where the sub-thermistor is continuously increased in temperature and the temperature exceeds a predetermined temperature, in order to close the shutter 53*a* or 53*b* on a side opposite from the side where the temperature is increased, the engine controller (CPU) 35 controls cooling fan driving circuits 56*a* and 56*b* so that one of the fans on the side where the temperature is increased is driven and the other fan is not driven. In this embodiment, each of the cooling fan driving circuits 56*a* and 56*b* is as shown in FIG. 16 and is capable of variably changing a rotation amount of the fan by outputting a PWM signal from the engine controller (CPU 35). As a specific circuit operation, when the PWM signal with a predetermined frequency is outputted from the engine controller (CPU) 35, a transistor 67 is turned on or off by a current passing through the circuit via a resistor 66. When the transistor 67 is turned on, in the case where the PWM signal is the "High" output signal, a transistor 69 connected to a collector of the transistor 67 via a resistor 68 is turned on, so that a current is passed through the fan 50 via a coil 70. At this time, energy is accumulated in the coil and at the same time, electric charges are stored in a capacitor 71. On the other hand, in the case where the PWM signal is the "Low" output signal, the voltage is pulled down to the ground (GND) potential by a resistor 72, so that the transistor 67 is turned off. A voltage pulled up to the power source voltage Vcc via a resistor 73 is applied to the transistor 69, so that the transistor 69 is turned off. As a result, the current is passed through a diode 74 by the energy accumulated in the coil 70 to be supplied to the fan 50. At this time, a voltage Vout to be outputted into the fan 50 is determined by a ratio between a cycle T of the PWM signal and a "High" signal output period Thi, and therefore in order to variably change the rotation amount of the fan 50, these values T and Thi may only be required to be changed.

Figures 17, 17A:
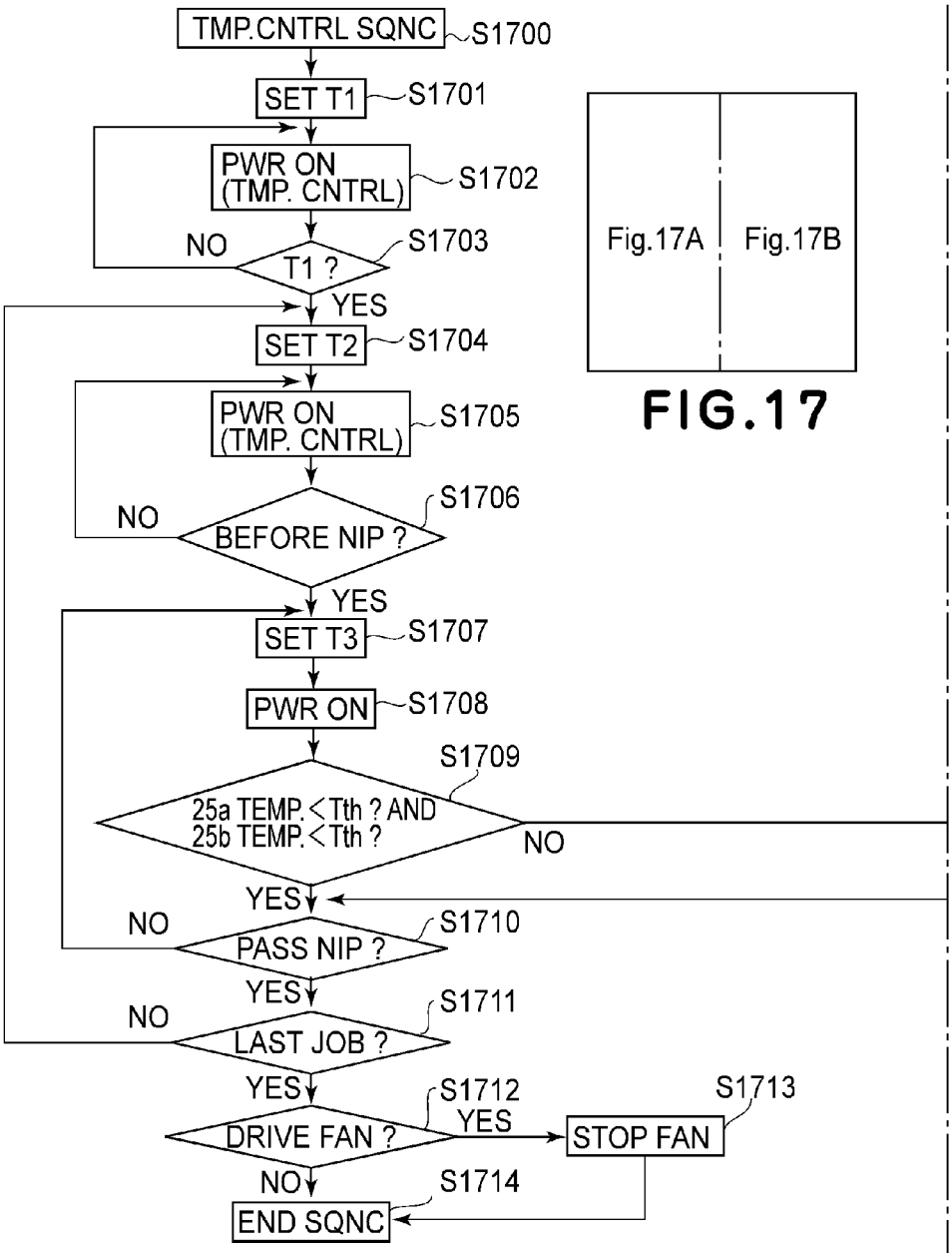
FIGS. 17A and 17B are flow charts showing a cooling control sequence during lateral shifting sheet passing in Embodiment 2.

A cooling control sequence during lateral shifting sheet passing in this embodiment will be described along with a flow chart shown in FIGS. 17A and 17B. In these figures, the sequence from S1700 to S1708 is the same as the sequence from S100 to S108 in Embodiment 1 and therefore will be omitted from the description.

Figure 17B:
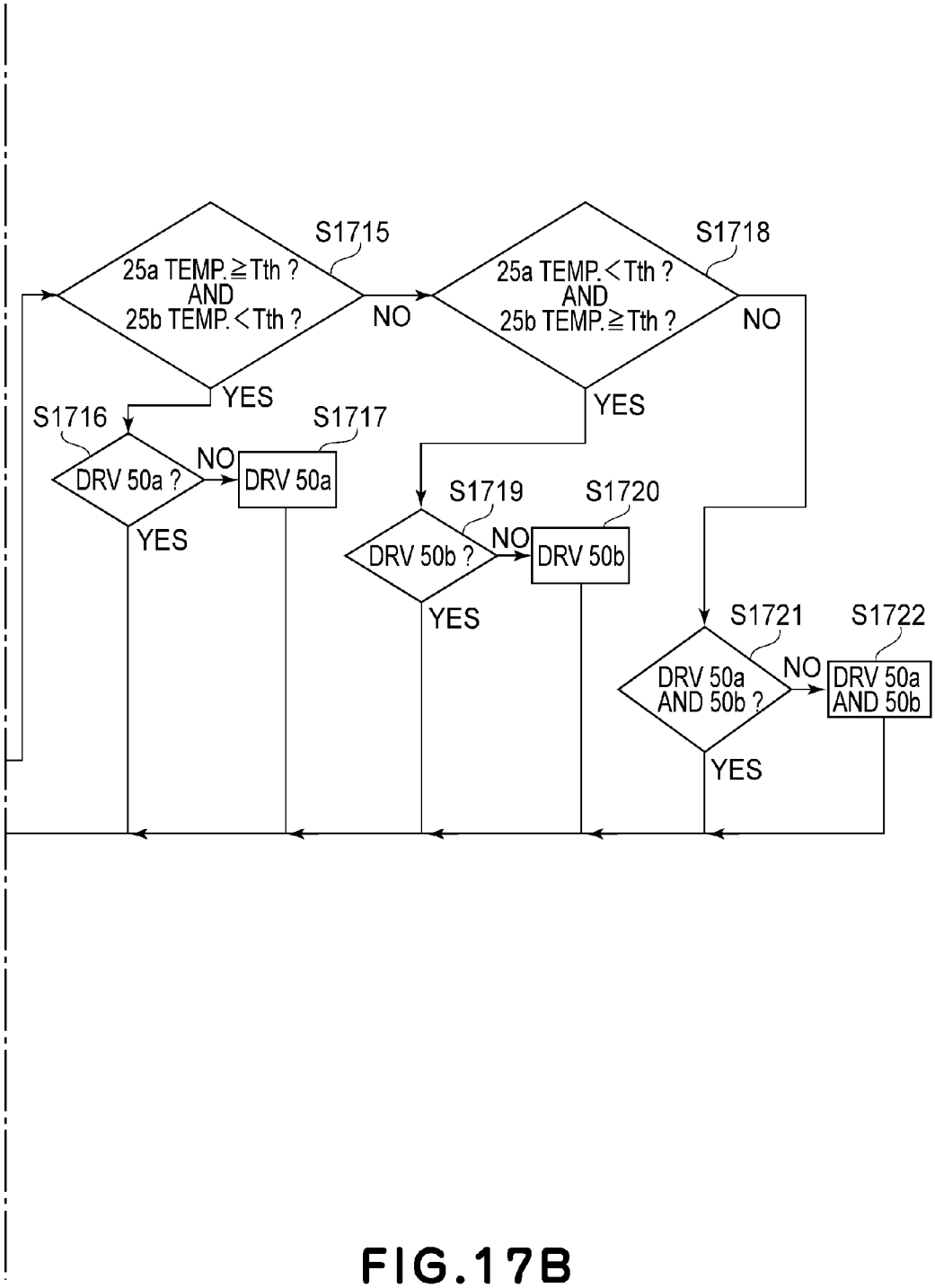
Figure 18:
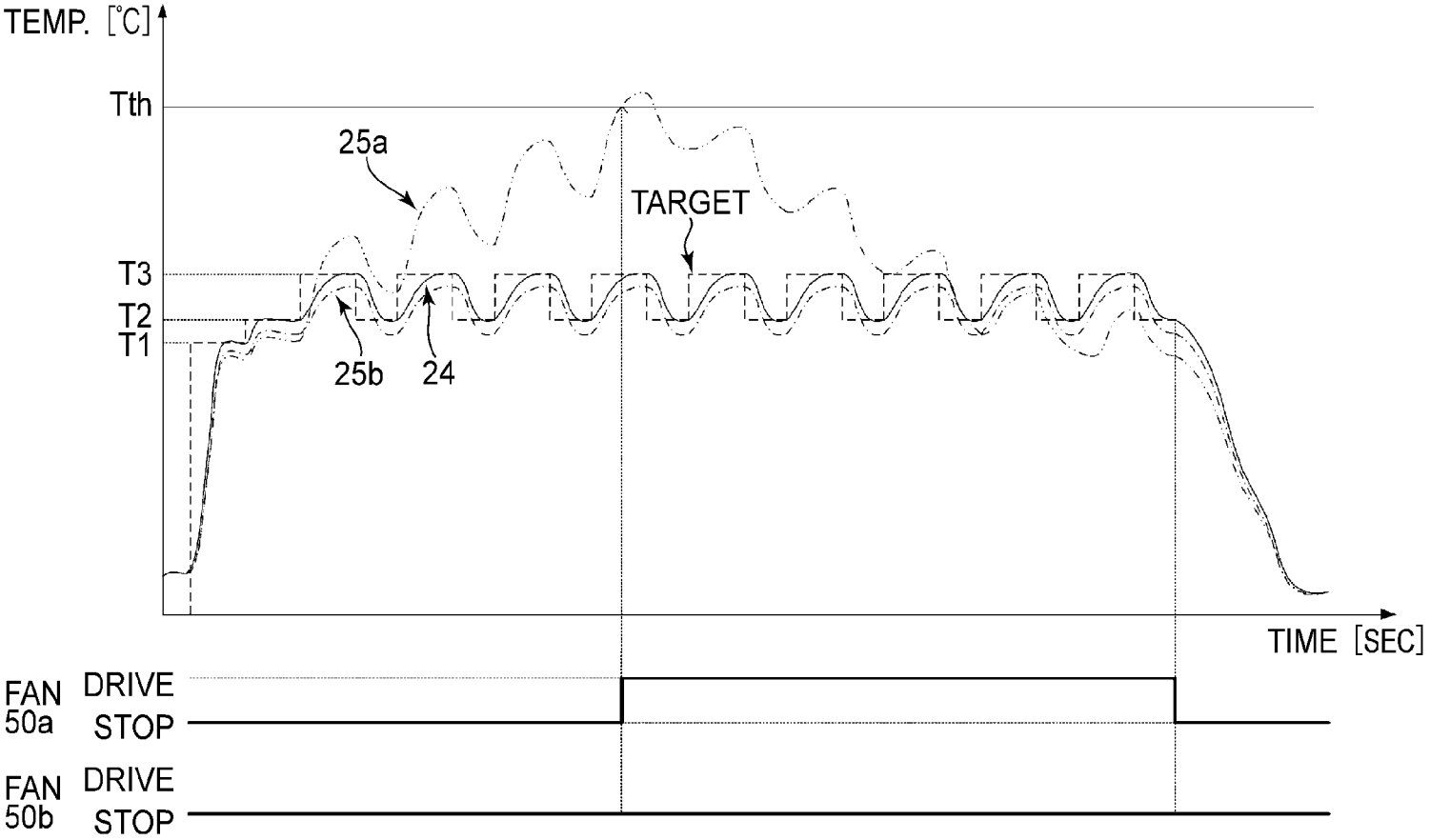
FIG. 18 is a time chart of a thermistor temperature change and drive of the fans in Embodiment 2.

In this embodiment, FIG. 18 shows a temperature change with time of the main thermistor 24 and the sub-thermistor 25*a* and 25*b* by taking, as an example, the case where the small-sized paper is subjected to the lateral shifting sheet passing in the side where the sub-thermistor 25*b* is provided. As shown in FIG. 18, when the small-sized paper is subjected to the lateral shifting sheet passing, the temperature of the sub-thermistor 25*a* on the side where the small-sized paper is not subjected to the lateral shifting sheet passing is increased. Then, when the temperature of the sub-thermistor 25*a* reaches a predetermined threshold Tth, with timing in S1709 of the flow chart of FIG. 17A, a condition of: (sub-thermistor 25*a* temperature)<Tth and (sub-thermistor 25*b* temperature)<Tth is not satisfied. In the case where this condition is not satisfied, the engine controller (CPU) 35 discriminates whether or not a condition of: (sub-thermistor 25*a* temperature)≥Tth and (sub-thermistor 25*b* temperature)<Tth is satisfied (S1715 in FIG. 17B). In this example, this condition is satisfied and therefore the engine controller (CPU) 35 checks whether or not the fan 50*a* is driven (S1716). In the case where the fan 50*a* is not driven, the fan 50*a* is driven (S1717) and then the engine controller (CPU) 35 checks whether or not a trailing end of the recording material P passes through the fixing nip (S1710). In the case where the trailing end of the recording material P does not pass through the fixing nip, the sequence is returned to S1707, in which the temperature control is repeated during the sheet passing through the fixing nip. When the passing of the trailing end of the recording material P through the fixing nip is detected, the engine controller (CPU) 35 checks whether or not a subsequent recording material for printing is present (S1711). When there is no subsequent recording material, the engine controller (CPU) 35 checks whether or not the fan is driven (S1712). When the fan is driven, the fan is stopped (S1713), and then the fixing sequence is ended (S1714).

Further, in the case where the small-sized paper is subjected to the lateral shifting sheet passing in the side, where the sub-thermistor 25*a* is provided, opposite from the side where the sub-thermistor 25*b* is provided, with timing in S1715 of the flow chart of FIG. 17B, the condition of: (sub-thermistor 25*a* temperature)≥Tth and (sub-thermistor 25*b* temperature)<Tth is not satisfied. In this case, the engine controller (CPU) 35 discriminates whether or not a condition of: (sub-thermistor 25*a* temperature)<Tth and (sub-thermistor 25*b* temperature)≥Tth is satisfied (S1718). In the case where the small-sized paper is subjected to the lateral shifting sheet passing in the sub-thermistor 25*a* side, this condition is satisfied and therefore the engine controller (CPU) 35 checks whether or not the fan 50*b* is driven (S1719). In the case where the fan 50*b* is not driven, the fan 50*b* is driven (S1720) and then the engine controller (CPU) 35 checks whether or not a trailing end of the recording material P passes through the fixing nip (S1710).

In the case where the condition in S1718 is not satisfied, the engine controller (CPU) 35 discriminates that the temperatures of the sub-thermistors 25*a* and 25*b* provided in both sides are increased and then checks, in order to drive both of the fans 50*a* and 50*b*, whether or not the fans 50*a* and 50*b* are driven (S1721). When the fans 50*a* and 50*b* are not driven, these fans 50*a* and 50*b* are driven (S1722). The control after S1722 is the same as that in the case where the small-sized paper is subjected to the lateral shifting sheet passing in the sub-thermistor 25*b* side.

In the control in this embodiment, similarly as in Embodiment 1, a sequence is performed in which the fan is driven when the sub-thermistor temperature exceeds the threshold temperature Tth, and then is continuously driven until the job is ended. However, control such that the driving of the fan is stopped when the sub-thermistor temperature is lowered to some extent may also be effected. That is, control with hysteresis with respect to the threshold temperature for determining ON/OFF of the fan driving may be effected.

Further, during the lateral shifting sheet passing, the region of the non-sheet-passing portion is larger than when the small-sized paper is passed through the fixing nip at the center conveyance reference position, so that a degree of the non-sheet-passing portion temperature rise becomes large. Therefore, there is a need to cool the fixing heater 16 by increasing an air flow rate compared with that during a normal operation. Thus, in the case where the lateral shifting sheet passing is detected, control such that the air flow rate is increased in a predetermined degree may also be effected.

Further, in the case where the sub-thermistor temperature is not lowered but is increased even when the above control is effected, in addition, control such that a second threshold temperature Tth2 is provided and the air flow rate of the fan is increased when the sub-thermistor temperature reaches the second threshold temperature Tth2 may also be effected.

In this embodiment, the air-blowing opening where the first cooling fan 50*a* is provided is a first cooling portion, and the air-blowing opening where the second cooling fan 50*b* is provided is a second cooling portion. Thus, also in this embodiment, with respect to the direction perpendicular to the recording material conveyance direction, the first cooling portion for cooling one of end portion regions of the fixing portion and the second cooling portion for cooling the other end portion region are provided and are drivable independently. In this embodiment, the first cooling fan 50*a* and the second cooling fan 50*b* are drivable independently from each other. Further, in the case where the recording material to be conveyed in the fixing nip is shifted in the direction perpendicular to the recording material conveyance direction to cause a temperature difference between the one end portion region and the other end portion region, only at the cooling portion corresponding to the higher-temperature end portion region, the cooling fan is driven.

Embodiment 3

This embodiment is different from Embodiments 1 and 2 in that a paper width detecting sensor for detecting the lateral shifting sheet passing is provided. The image forming apparatus in this embodiment has the same mechanical constitution as that of the image forming apparatus in Embodiment 1 except for the arrangement of the thermistor and the paper width detecting sensor, thus being omitted from the description. In the following, the arrangement of the thermistor and the paper width detecting sensor and the cooling control sequence during lateral shifting sheet passing will be described in this order. Portions or means of the fixing device which have the same functions as those of the fixing device in Embodiment 1 are represented by the same reference numerals or symbols.

(Arrangement of Thermistor and Paper Width Detecting Sensor)

Figure 19:
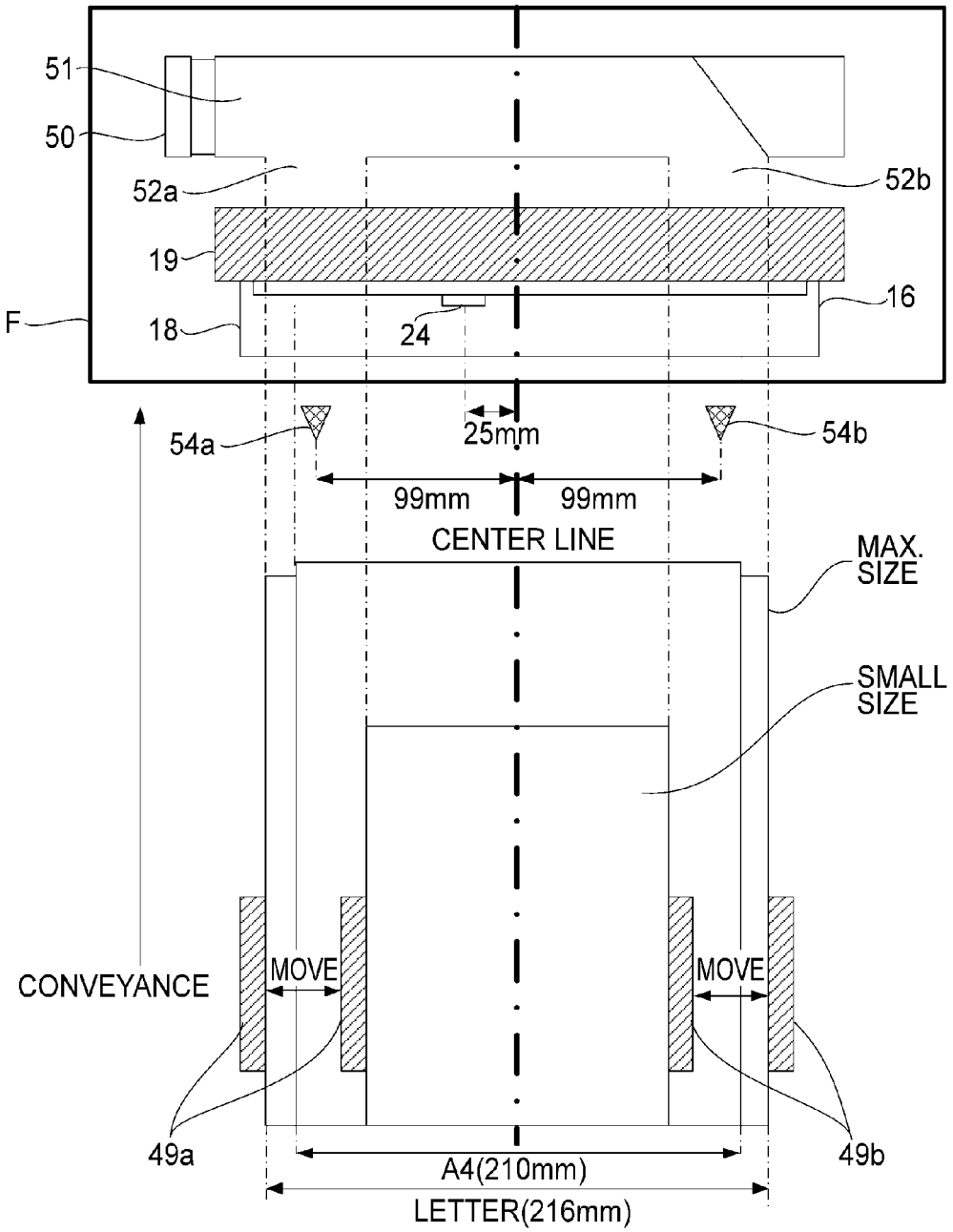
FIG. 19 is an arrangement view of paper width detecting sensors and a duct with respect to a widthwise direction in Embodiment 3.

FIG. 19 shows a positional relation, with respect to the widthwise direction perpendicular to the recording material conveyance direction in the fixing device F, among the main thermistor 24, paper width detecting sensors 54*a* and 54*b*, the maximum-sized paper and the small-sized paper which are conveyable through the sheet feeding port, and the air-blowing openings 52*a* and 52*b* for the cooling air. As shown in FIG. 19, a cooling fan 50 as the cooling portion in this embodiment and a duct 51 constituting an air-blowing path through which the cooling air from the cooling fan 50 is sent to the fixing device F are provided. The duct 51 is provided with air-blowing openings 52*a* and 52*b* for cooling the pressing roller 19. The arrangement relation among the main thermistor 24 and the air-blowing openings 52*a* and 52*b* is the same as that in Embodiment 1 and therefore will be omitted from the description.

The paper width detecting sensors 54*a* and 54*b* are disposed at positions which are located within the sheet passing region of the maximum-sized paper and which constitute a non-sheet-passing portion when the small-sized paper is passed through the fixing device. The paper width detecting sensors 54*a* and 54*b* are disposed equidistantly from the center reference position in a bilaterally symmetrical manner. In FIG. 19, the left-hand paper width detecting sensor is 54*a* and the right-hand paper width detecting sensor is 54*b*. In this embodiment, paper smaller in size than A4-sized paper (of 210 mm in width) is treated as the small-sized paper and therefore each of the paper width detecting sensors 54*a* and 54*b* is disposed so that its detecting point (position) is located at a position of 99 mm from the center reference position. Whether or not what-sized recording material is treated as the small-sized paper varies depending on the image forming apparatus and therefore the position of each paper width detecting sensor from the center reference position varies depending on a target small-sized paper. When the paper (sheet) has a predetermined size or more, levers of the paper width detecting sensors 54*a* and 54*b* are moved down (tilted) to turn on the paper width detecting sensors 54*a* and 54*b*, so that passing of the paper is detected. Further, when the levers are not moved down, the paper width detecting sensors 54*a* and 54*b* are turned off to detect that there is no paper at the sensor positions and thus the small-sized paper passing or the lateral shifting sheet passing is performed. Incidentally, in this embodiment, the paper width detecting sensors are disposed between the sheet feeding portion and the transfer portion but may also be disposed at any positions so long as they are located within the conveyance path.

(Cooling Control Sequence During Lateral Shifting Sheet Passing)

Figure 20:
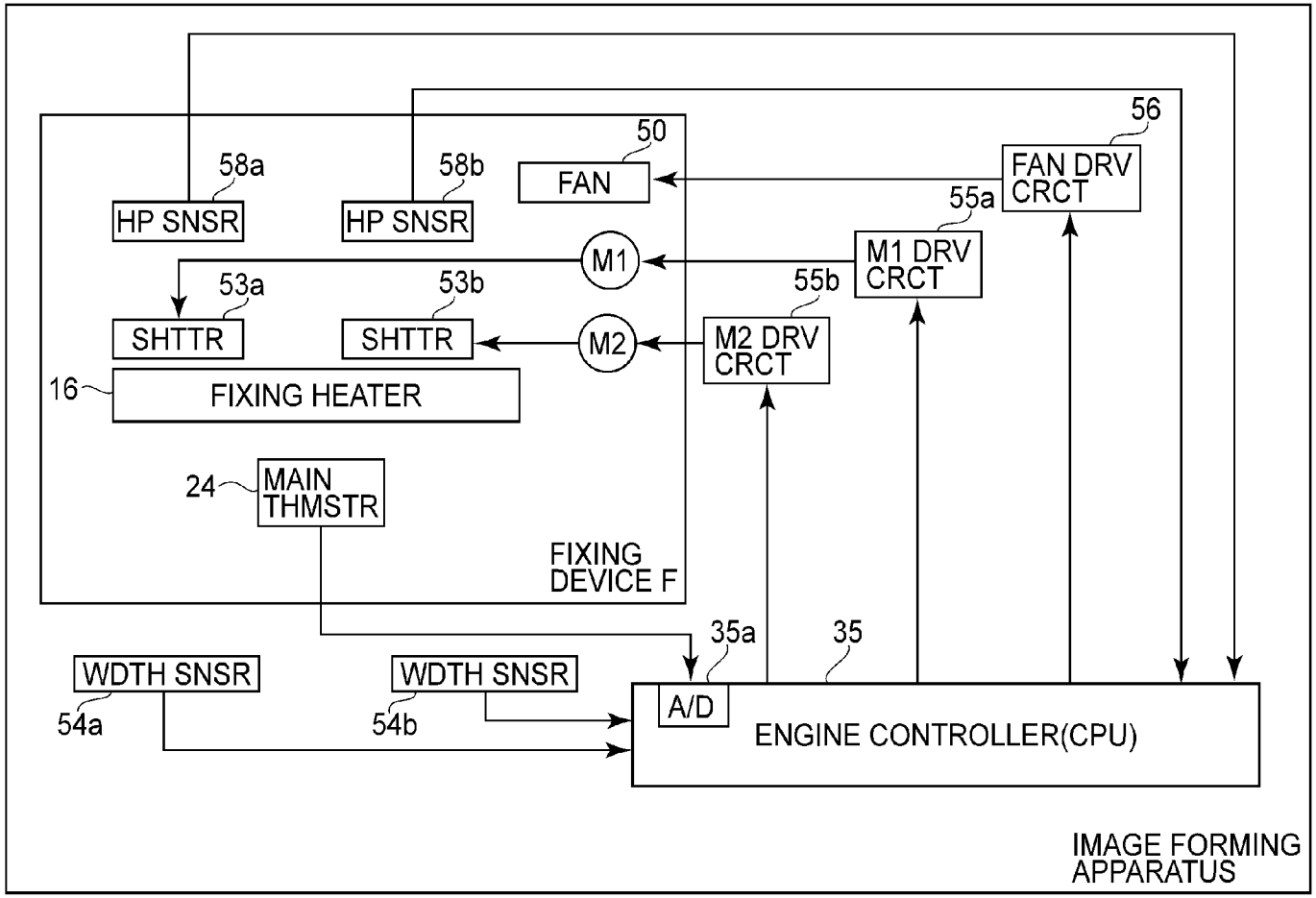
FIG. 20 is a block diagram of a control system for a cooling fan, shutters and the paper width detecting sensors in Embodiment 3.

With reference to a block diagram of FIG. 20, a constitution of cooling control during lateral shifting sheet passing will be described. During printing, a detection result of the presence/absence of the paper by the paper width detecting sensors 54*a* and 54*b* is inputted into the engine controller (CPU) 35. At this time, in the case of lateral shifting sheet passing, either one of the paper width detecting sensors 54*a* and 54*b* detects the presence of the paper. When the engine controller (CPU) 54 detects the lateral shifting sheet passing, in order to close the shutter 53*a* or 53*b* in the lateral shifting sheet passing side, the engine controller (CPU) 35 controls a shutter motor driving circuit 55*a* or 55*b* to drive a shutter motor M1 or M2. After the shutter is closed, a cooling fan driving circuit 56 is controlled to drive a fan 50. In this embodiment, as the shutter motors M1 and M2, similarly as in Embodiment 1, the pulse motor is used.

Figures 21, 21A:
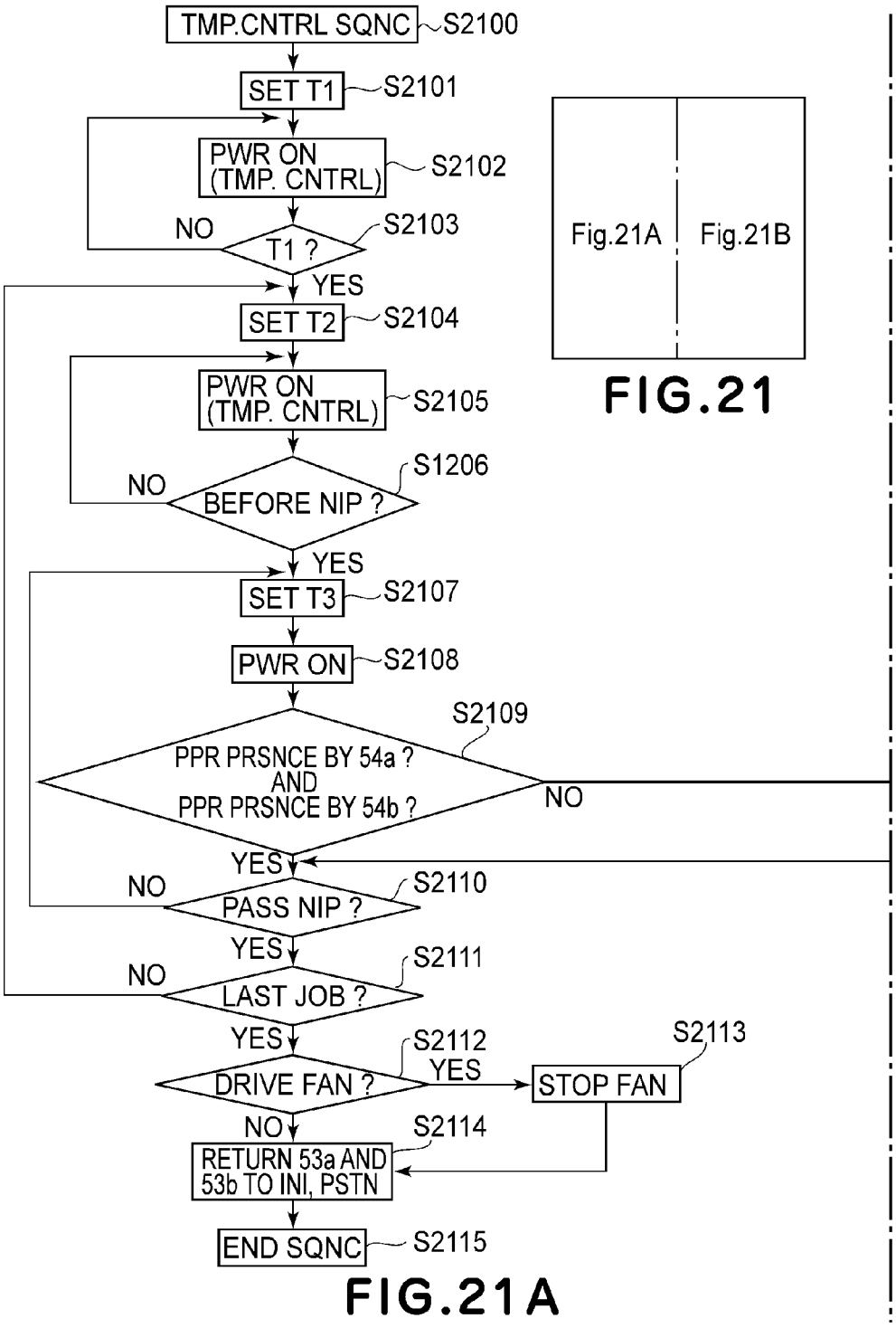
FIGS. 21A and 21B are flow charts showing a cooling control sequence during lateral shifting sheet passing in Embodiment 3.

A cooling control sequence during lateral shifting sheet passing in this embodiment will be described along a flow chart shown in FIGS. 21A and 21B. In these figures, the sequence from S2100 to S2108 is the same as the sequence from S100 to S108 in Embodiment 1 and therefore will be omitted from the description.

In this embodiment, the case where the small-sized paper is subjected to the lateral shifting sheet passing in the paper width detecting sensor 54*b* side will be described. With timing in S2109 of the flow chart of FIG. 21A, the engine controller (CPU) 35 checks a condition of the paper presence by the paper width detecting sensor 54*a* and the paper presence by the paper width detecting sensor 54*b*. In the case where this condition is not satisfied, the engine controller (CPU) 35 discriminates whether or not a condition of the paper absence by the paper width detecting sensor 54*a* and the paper presence by the paper width detecting sensor 54*b* is satisfied (S2116 in FIG. 21B). In this example, this condition is satisfied and therefore the engine controller (CPU) 35 checks whether or not the shutter 53*b* closes the air-blowing opening 52*b* (S2117). In the case where the shutter 53*b* does not close the air-blowing opening 52*b*, the shutter 53*b* is driven to close the air-blowing opening 52*b* (S2118) and then the engine controller (CPU) 35 checks whether or not the fan is driven (S2119). In the case where the fan is not driven, the fan is driven (S2120) and then the engine controller (CPU) 35 checks whether or not a trailing end of the recording material P passes through the fixing nip (S2110). In the case where the trailing end of the recording material P does not pass through the fixing nip, the sequence is returned to S2107, in which the temperature control is repeated during the sheet passing. When the passing of the trailing end of the recording material P through the fixing nip is detected, the engine controller (CPU) 35 checks whether or not a subsequent recording material for printing is present (S2111). When there is no subsequent recording material, the engine controller (CPU) 35 checks whether or not the fan is driven (S2112). When the fan is driven, the fan is stopped (S2113), and then the shutters 53*a* and 53*b* are returned to their initial positions (S2114). Then, the fixing sequence is ended (S2115).

Figure 21B:
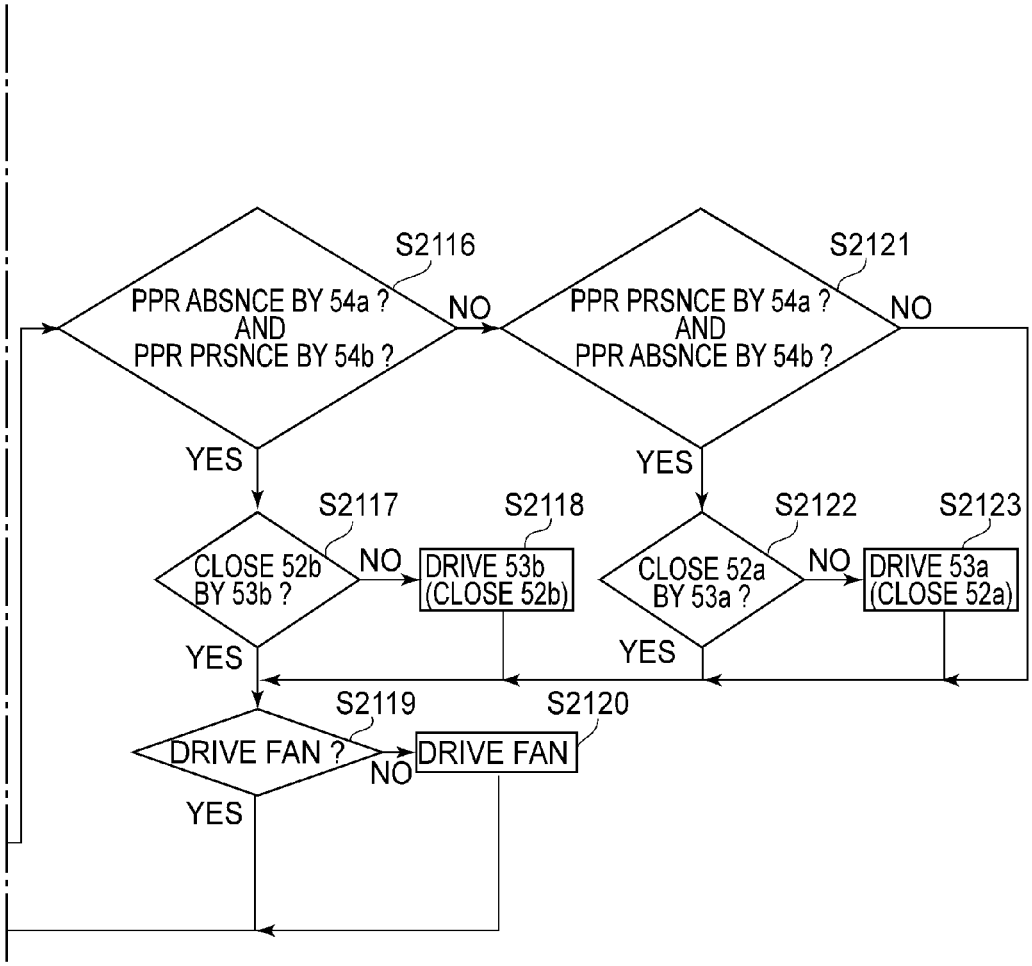

Further, in the case where the small-sized paper is subjected to the lateral shifting sheet passing in the side, where the paper width detecting sensor 54*a* is provided, opposite from the side where the sub-thermistor 25*b* is provided, with timing in S2116 of the flow chart of FIG. 21B, the condition of the paper absence by the paper width detecting sensor 54*a* and the paper presence by the paper width detecting sensor 54*b* is not satisfied. In this case, the engine controller (CPU) 35 discriminates whether or not a condition of the paper presence by the paper width detecting sensor 54*a* and the paper absence by the paper width detecting sensor 54*b* is satisfied (S2121). In the case where the small-sized paper is subjected to the lateral shifting sheet passing in the paper width detecting sensor 54*a* side, this condition is satisfied and therefore the engine controller (CPU) 35 checks whether or not the shutter 53*a* closes the air-blowing opening 52*a* (S2122). In the case where the shutter 53*a* does not close the air-blowing opening 52*a*, the shutter 53*a* is driven to close the air-blowing opening 52*a* (S2123) and then the engine controller (CPU) 35 checks whether or not the fan is driven (S2119). In the case where the fan is not driven, the fan is driven (S2120) and then the engine controller (CPU) 35 checks whether or not a trailing end of the recording material P passes through the fixing nip (S2110).

In the case where the condition in S2121 is not satisfied, the engine controller (CPU) 35 discriminates that the temperatures at the both end portions are increased and then checks whether or not the fan is driven without closing both ducts (S2119). When the fan is not driven, the fan is driven (S2120). The control after S2120 is the same as that in the case where the small-sized paper is subjected to the lateral shifting sheet passing in the paper width detecting sensor 54*b* side.

During the lateral shifting sheet passing, the region of the non-sheet-passing portion is larger than when the small-sized paper is passed through the fixing nip at the center conveyance reference position, so that a degree of the non-sheet-passing portion temperature rise becomes large. Therefore, there is a need to cool the fixing heater 16 by increasing an air flow rate compared with that during a normal operation. Thus, in the case where the lateral shifting sheet passing is detected, control such that the air flow rate is increased in a predetermined degree may also be effected.

As in Embodiments 1 and 2, the constitution in which the two sub-thermistors are disposed can directly detect the temperature of the fixing device and therefore has the advantage of being highly safe, whereas the constitution has the disadvantage of a high cost. On the other hand, as in this embodiment, by employing the constitution in which the two recording material detecting means for detecting the presence/absence of the recording material are disposed at any positions on the conveyance path in the both widthwise sides, the cost can be suppressed.

In this embodiment, similarly as in Embodiment 1, the air-blowing opening where the first shutter 53*a* and the opening 52*a* are provided is a first cooling portion, and the air-blowing opening where the second shutter 53*b* and the opening 52*b* are provided is a second cooling portion. Thus, in this embodiment, with respect to the direction perpendicular to the recording material conveyance direction, the first cooling portion for cooling one of end portion regions of the fixing portion and the second cooling portion for cooling the other end portion region are provided and are drivable independently. In this embodiment, the first shutter 53*a* and the second shutter 53*b* are operable independently from each other. Further, the lateral shifting detecting mechanism for detecting the lateral shifting of the recording material in the direction perpendicular to the recording material conveyance direction is provided and on the basis of its detection result, the first and second cooling portions (first and second shutters) are driven.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 125268/2011 filed Jun. 3, 2011, which is hereby incorporated by reference.

What is claimed is:

1. An image forming apparatus comprising:

a fixing portion configured to fix an image on a recording material by heating the image carried on the recording material while conveying the recording material by a fixing nip, said fixing portion including a cylindrical fixing film, a heater contacted to an inner surface of the fixing film, and a pressing roller configured to form the fixing nip together with the pressing roller through the fixing film;

a first cooling portion configured to cool one end region of said fixing portion with respect to a direction perpendicular to a recording material conveyance direction; and a second cooling portion configured to cool the other end region of said fixing portion with respect to the direction perpendicular to the recording material conveyance direction;

a first temperature detecting element configured to detect a temperature of the one end portion region of the heater; and a second temperature detecting element configured to detect a temperature of the other end portion region of the heater, wherein said first cooling portion is driven depending on a detection temperature of the first temperature detecting element and said second cooling portion is driven depending on a detection temperature of the second temperature detecting element, and wherein said first cooling portion and said second cooling portion are operable independently from each other.

2. An apparatus according to claim 1, wherein each of said first cooling portion and said second cooling portion includes a shutter configured to open and close an opening through which cooling air is to be blown into the end portion region of said fixing portion, and wherein when the recording material conveyed in the fixing nip is shifted in the direction perpendicular to the recording material conveyance direction to cause a temperature difference between the one end portion region of the heater and the other end portion region of the heater, the cooling portion configured to cool the end portion region of said fixing portion where a temperature is high positions its shutter at a position where its opening is open so that the cooling air can be blown into the end portion region of said fixing portion, and the other cooling portion positions its shutter at a position where its opening is closed.

3. An apparatus according to claim 1, wherein each of said first cooling portion and said second cooling portion includes a fan configured to blow cooling air into the end portion region of said fixing portion, and wherein when the recording material conveyed in the fixing nip is shifted in the direction perpendicular to the recording material conveyance direction to cause a temperature difference between the one end portion region of the heater and the other end portion region of the heater, only the cooling portion configured to cool the end portion region of said fixing portion where a temperature is high is driven.

4. An apparatus according to claim 1, wherein each of said first cooling portion and said second cooling portion includes a fan configured to blow cooling air into the end portion region of said fixing portion, and wherein the fan is capable of changing an air flow rate.

5. An image forming apparatus comprising:

a fixing portion configured to fix an image on a recording material by heating the image carried on the recording material while conveying the recording material by a fixing nip;

a first cooling portion configured to cool one end region of said fixing portion with respect to a direction perpendicular to a recording material conveyance direction; and a second cooling portion configured to cool the other end region of said fixing portion with respect to the direction perpendicular to the recording material conveyance direction; and a lateral shifting detecting mechanism configured to detect lateral shifting of the recording material in the direction perpendicular to the recording material conveyance direction, wherein said first cooling portion and said second cooling portion are driven depending on a detection result of said lateral shifting detecting mechanism, and wherein said first cooling portion and said second cooling portion are operable independently from each other.

6. An apparatus according to claim 5, wherein each of said first cooling portion and said second cooling portion includes a shutter configured to open and close an opening through which cooling air is to be blown into the end portion region, and wherein when the recording material conveyed in the fixing nip is shifted in the direction perpendicular to the recording material conveyance direction to cause a temperature difference between the one end portion region and the other end portion region, the cooling portion configured to cool the end portion region where a temperature is high positions its shutter at a position where its opening is open so that the cooling air can be blown into the end portion region, and the other cooling portion positions its shutter at a position where its opening is closed.

7. An apparatus according to claim 5, wherein each of said first cooling portion and said second cooling portion includes a fan configured to blow cooling air into the end portion region, and wherein when the recording material conveyed in the fixing nip is shifted in the direction perpendicular to the recording material conveyance direction to cause a temperature difference between the one end portion region and the other end portion region, only the cooling portion configured to cool the end portion region where a temperature is high is driven.

8. An apparatus according to claim 5, wherein each of said first cooling portion and said second cooling portion includes a fan configured to blow cooling air into the end portion region, and wherein the fan is capable of changing the air flow rate.

9. An apparatus according to claim 5, wherein said fixing portion includes a cylindrical fixing film.

10. An apparatus according to claim 9, wherein said fixing portion includes a heater contacted to an inner surface of the fixing film and a pressing roller configured to form the fixing nip together with the heater through the fixing film.

11. An image forming apparatus comprising:

a fixing portion configured to fix an image on a recording material by heating the image carried on the recording material while conveying the recording material by a fixing nip;

a first cooling portion configured to cool one end region of said fixing portion with respect to a direction perpendicular to a recording material conveyance direction, wherein said first cooling portion includes a first shutter configured to open and close an opening through which cooling air is to be blown into the one end region; and a second cooling portion configured to cool the other end region of said fixing portion with respect to the direction perpendicular to the recording material conveyance direction, wherein said second cooling portion includes a second shutter configured to open and close an opening through which cooling air is to be blown into the other end region, wherein said first shutter and said second shutter are operable independently from each other so that a state in which a size of the opening of the first cooling portion and a size of the opening of the second cooling portion are different from each other is settable, and wherein said first and second shutters are operable in accordance with a lateral shifting of the recording material in the direction perpendicular to the recording material conveyance direction.

12. An apparatus according to claim 11, wherein the cooling air blown into the one end region and the cooling air blown into the other end region branch off from air generated by the drive of a single fan.

13. An apparatus according to claim 11, further comprising a lateral shifting detecting mechanism configured to detect lateral shifting of the recording material in the direction perpendicular to the recording material conveyance direction, wherein said first and second shutters are operable in accordance with an output of said lateral shifting detecting mechanism.

14. An apparatus according to claim 11, wherein said fixing portion includes a cylindrical fixing film.

15. An apparatus according to claim 14, wherein said fixing portion includes a heater contacted to an inner surface of the fixing film and a pressing roller configured to form the fixing nip together with the heater through the fixing film.

16. An image forming apparatus comprising:

a fixing portion configured to fix an image on a recording material by heating the image carried on the recording material while conveying the recording material by a fixing nip, said fixing portion including a cylindrical fixing film, a heater contacted to an inner surface of the fixing film, and a pressing roller configured to form the fixing nip together with the pressing roller through the fixing film;

a first cooling fan configured to cool one end region of said fixing portion with respect to a direction perpendicular to a recording material conveyance direction;

a second cooling fan configured to cool the other end region of said fixing portion with respect to the direction perpendicular to the recording material conveyance direction;

a first temperature detecting element configured to detect a temperature of the one end portion region of the heater; and a second temperature detecting element configured to detect a temperature of the other end portion region of the heater, wherein said first cooling fan is driven depending on a detection temperature of the first temperature detecting element and said second cooling fan is driven depending on a detection temperature of the second temperature detecting element.

17. An apparatus according to claim 16, further comprising a first shutter configured to open and close an opening through which cooling air by said first cooling fan is to be blown into the one end portion region of said fixing portion, and a second shutter configured to open and close an opening through which cooling air by said second cooling fan is to be blown into the other end portion region of said fixing portion.

18. An apparatus according to claim 16, wherein said first cooling fan blows cooling air when the detection temperature of said first temperature detecting element is higher than a threshold temperature and said second cooling fan blows cooling air when the detection temperature of said second temperature detecting element is higher than the threshold temperature.

19. An apparatus according to claim 16, wherein said first cooling fan is capable of changing the air flow rate in accordance with the detection temperature of said first temperature detecting element, and said second cooling fan is capable of changing the air flow rate in accordance with the detection temperature of said second temperature detecting element.

20. An apparatus according to claim 16, wherein when the recording material conveyed in the fixing nip is shifted in the direction perpendicular to the recording material conveyance direction to cause the temperature of the one end portion region of the heater is higher than the temperature of the other end portion region of the heater, the air flow rate of said first cooling fan is increased compared with the air flow rate when the recording material is passed through the fixing nip in a state in which the widthwise center of the recording material coincides with a center conveyance reference position.

* * * * *